US011236434B2

(12) United States Patent
Tsushima

(10) Patent No.: US 11,236,434 B2
(45) Date of Patent: Feb. 1, 2022

(54) DEVICE THAT HOLDS SUBSTRATE IN SUBSTRATE HOLDER AND/OR RELEASES HOLDING OF SUBSTRATE USING SUBSTRATE HOLDER, AND PLATING APPARATUS INCLUDING THE SAME

(71) Applicant: EBARA CORPORATION, Tokyo (JP)

(72) Inventor: Takuya Tsushima, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 158 days.

(21) Appl. No.: 16/592,770

(22) Filed: Oct. 4, 2019

(65) Prior Publication Data

US 2020/0109485 A1 Apr. 9, 2020

(30) Foreign Application Priority Data

Oct. 5, 2018 (JP) ..... JP2018-190116

(51) Int. Cl.
*C25D 17/06* (2006.01)

(52) U.S. Cl.
CPC ..... *C25D 17/06* (2013.01)

(58) Field of Classification Search
CPC ..... H01L 21/67778; C25D 17/06
See application file for complete search history.

(56) References Cited

FOREIGN PATENT DOCUMENTS

JP 2012107311 6/2012

*Primary Examiner* — Ho-Sung Chung
(74) *Attorney, Agent, or Firm* — JCIPRNET

(57) ABSTRACT

A substrate attachment and detachment device appropriate for a double-sided holder is provided. The substrate attachment and detachment device is a device that holds a substrate in a substrate holder and/or releases the holding of the substrate using the substrate holder. The substrate holder includes a first frame and a second frame. The first frame and the second frame have openings, respectively. The device includes a substrate supporting unit that sandwiches the substrate between the first frame and the second frame. The substrate supporting unit includes a lower substrate supporter, and an upper substrate supporter. The lower substrate supporter is configured to come into contact with the substrate through the opening of the frame positioned on a lower side. The upper substrate supporter is configured to come into contact with the substrate through the opening of the frame positioned on an upper side.

12 Claims, 20 Drawing Sheets

DEVICE THAT HOLDS SUBSTRATE IN SUBSTRATE HOLDER AND/OR RELEASES HOLDING OF SUBSTRATE USING SUBSTRATE HOLDER, AND PLATING APPARATUS INCLUDING THE SAME

CROSS-REFERENCE TO RELATED APPLICATION

This application claims the priority of Japan patent application serial no. 2018-190116, filed on Oct. 5, 2018. The entirety of the above-mentioned patent application is hereby incorporated by reference herein and made a part of this specification.

BACKGROUND OF THE DISCLOSURE

Technical Field

The disclosure relates to a device that holds a substrate in a substrate holder and/or releases the holding of the substrate using the substrate holder, and a plating apparatus including the device.

Related Art

Conventionally, a plating apparatus that performs plating on a substrate has been known. Patent literature 1 discloses a plating apparatus including a substrate attachment and detachment device ("substrate-holder opening and closing mechanism 102" in Patent literature 1) that holds a substrate in a substrate holder and releases the holding of the substrate using the substrate holder.

[Patent literature 1] Japanese Laid-Open No. 2012-107311

SUMMARY

In Patent literature 1, the substrate holder (one-sided holder) that performs plating on only one side of the substrate is used. Meanwhile, the use of a substrate holder (double-sided holder) that performs plating on both surfaces of the substrate is not considered in Patent literature 1. Thus, the application provides a substrate attachment and detachment device appropriate for a double-sided holder.

The application discloses, as an embodiment, a device that holds a substrate in a substrate holder and/or releases the holding of the substrate using the substrate holder. The substrate holder includes a first frame and a second frame that sandwich the substrate. The first frame and the second frame have openings that expose the substrate, respectively. The device includes a substrate supporting unit that sandwiches the substrate between the first frame and the second frame. The substrate supporting unit includes a lower substrate supporter that supports the substrate from below, and an upper substrate supporter that supports the substrate from above. The lower substrate supporter is configured to come into contact with the substrate through the opening of a frame of the first frame and the second frame which is positioned on a lower side. The upper substrate supporter is configured to come into contact with the substrate through the opening of a frame of the first frame and the second frame which is positioned on an upper side.

DESCRIPTION OF THE EMBODIMENTS

<Plating Apparatus>

Figure 1A:
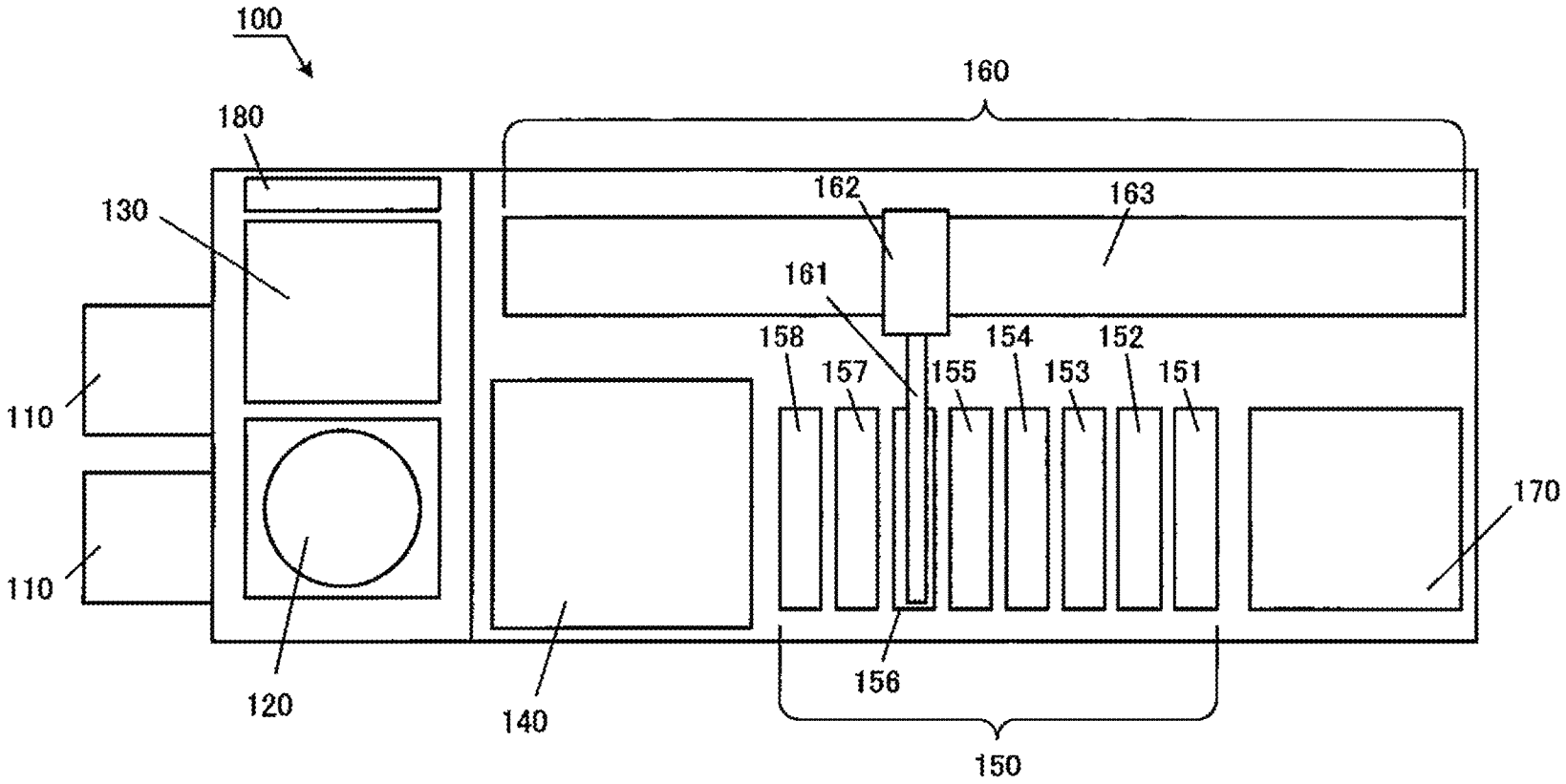
FIG. 1A is a top view of a plating apparatus according to an embodiment.
Figure 1B:
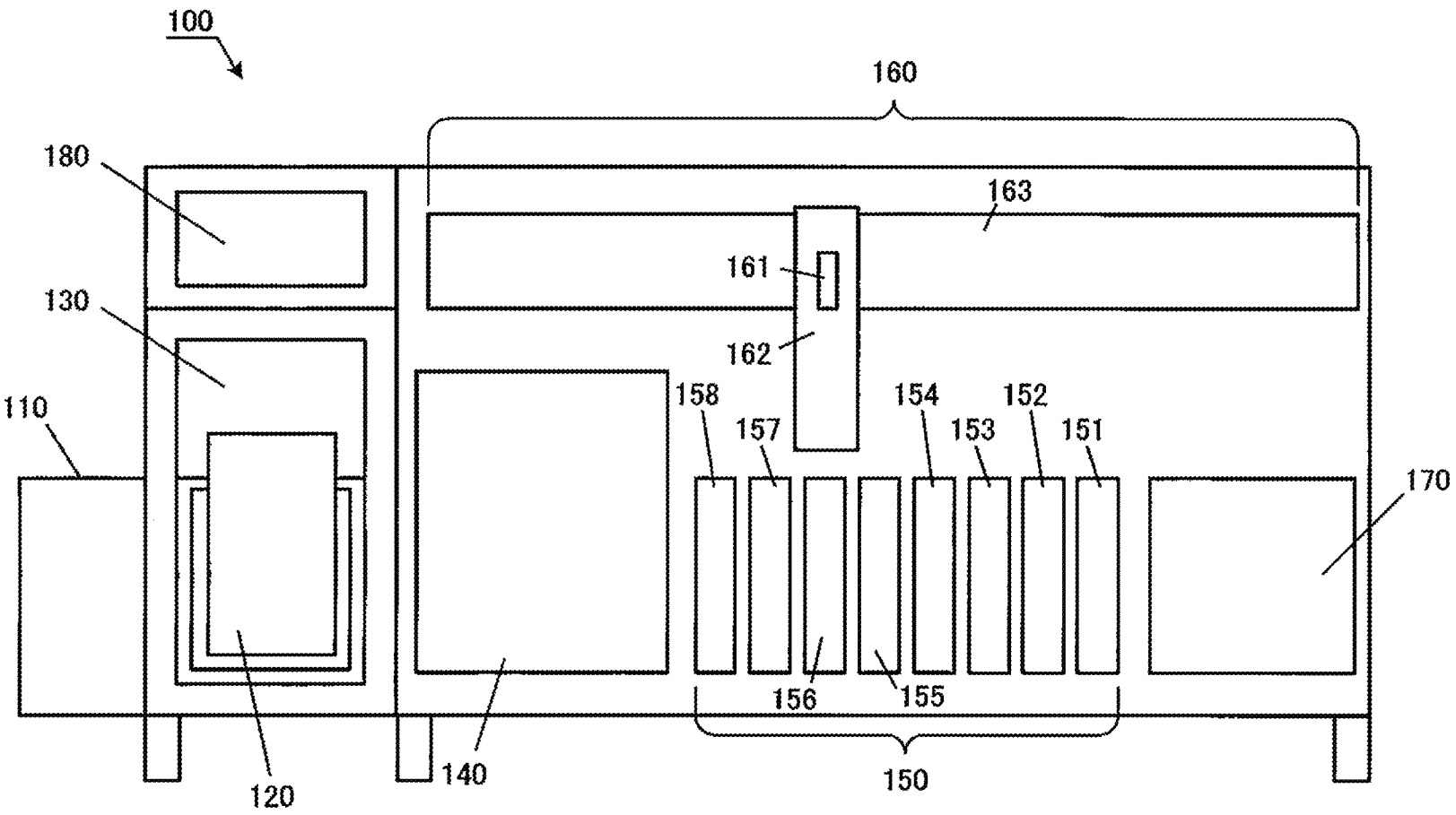
FIG. 1B is a front view of the plating apparatus according to the embodiment.

FIGS. 1A and 1B are schematic diagrams of a plating apparatus 100 according to an embodiment. FIG. 1A is a top view of the plating apparatus 100. FIG. 1B is a front view of the plating apparatus 100. The plating apparatus 100 according to the embodiment includes loading ports 110, a substrate transfer robot 120, a dryer 130, a substrate attachment and detachment device 140, a plating treatment portion 150, a transporter 160, and a stocker 170. The plating apparatus 100 may further include a control portion 180 for controlling the sections of the plating apparatus 100.

The loading ports 110 are arranged for loading a substrate onto the plating apparatus 100 and unloading the substrate from the plating apparatus 100. The loading ports 110 may be configured to be capable of mounting a mechanism such as a FOUP or capable of transporting the substrate between the loading ports 110 and a mechanism such as a FOUP.

The substrate loaded by the loading port 110 is transferred by the substrate transfer robot 120. Specifically, the substrate transfer robot 120 is configured to be capable of transferring the substrate between the loading port 110, the dryer 130, and the substrate attachment and detachment device 140. However, a transfer mechanism other than the substrate transfer robot 120 may be used. "Transferring the substrate to the loading port 110" in the specification includes "transferring the substrate to a mechanism such as a FOUP mounted on the loading port 110". The dryer 130 is arranged for drying the substrate already treated by the plating treatment portion 150.

The substrate attachment and detachment device 140 is a device that holds the substrate in a substrate holder and/or releases the holding of the substrate using the substrate holder. The substrate attachment and detachment device 140 of FIGS. 1A and 1B can hold the substrate on the substrate holder and can release the holding of the substrate using the substrate holder. Meanwhile, the substrate attachment and detachment device 140 that holds the substrate on the substrate holder and the substrate attachment and detachment device 140 that releases the holding of the substrate using the substrate holder may be separately arranged, or there may be only one of the two substrate attachment and detachment device 140. Both the substrate and the substrate holder need to be loaded into the substrate attachment and detachment device 140. Thus, the substrate attachment and detachment device 140 is positioned at a position accessible by both the substrate transfer robot 120 and the transporter 160. The details of the substrate attachment and detachment device 140 are described later.

The plating treatment portion 150 is arranged for performing a plating treatment (plating processing) on the substrate. The plating treatment portion 150 includes one treatment tank or a plurality of treatment tanks. At least one of the one treatment tank or the plurality of treatment tanks is a plating tank. As an example, the treatment portion 150 of FIGS. 1A and 1B includes eight treatment tanks, that is, a pre-water washing tank 151, a pre-treatment tank 152, a first rinse tank 153, a first plating tank 154, a second rinse tank 155, a second plating tank 156, a third rinse tank 157, and a blow tank 158. The plating apparatus 100 can perform predetermined treatments in the treatment tanks in order.

The transporter 160 is configured to transfer the substrate holder between the substrate attachment and detachment device 140, the plating treatment portion 150, and the stocker 170. The transporter 160 is configured to transfer the substrate holder between the treatment tanks (the pre-water washing tank 151 to the blow tank 158). The transporter 160 includes a transporter arm 161 that suspends the substrate holder, an arm vertical movement mechanism 162 that vertically moves the transporter arm 161, and a horizontal movement mechanism 163 that horizontally moves the arm vertical movement mechanism 162 along the arrangement of the treatment tanks. The horizontal movement mechanism 163 may also be referred to as a mechanism that horizontally moves the transporter arm 161. It should be noted that the configuration of the transporter 160 is merely an example.

The stocker 170 is configured to be capable of storing at least one substrate holder, preferably, a plurality of substrate holders. The control portion 180 according to the embodiment controls the transporter 160 so that a substrate holder of the substrate holders stored in the stocker 170 which does not hold the substrate is taken out. Thereafter, the control portion 180 controls the substrate attachment and detachment device 140 and the transporter 160 so that the substrate holder taken out is transferred to the substrate attachment and detachment device 140. Subsequently, the control portion 180 controls the substrate attachment and detachment device 140 so that the substrate is held by the substrate holder. The substrate to be held by the substrate holder is transferred to the substrate attachment and detachment device 140 from the loading port 110 by the substrate transfer robot 120. Through the aforementioned procedure, the substrate holder not holding a substrate becomes the "substrate holder holding the substrate". Thereafter, the control portion 180 controls the substrate attachment and detachment device 140 and the transporter 160 so that the substrate holder holding the substrate is taken out from the substrate attachment and detachment device 140. Subsequently, the control portion 180 controls the transporter 160 so that the substrate holder is transferred to the plating treatment portion 150.

In a case that it is necessary to release the holding of the substrate using the substrate holder such as a case when the plating treatment is ended, the control portion 180 controls the elements of the plating apparatus 100 in a substantially reverse procedure of the aforementioned procedure. That is, the control portion 180 controls the substrate attachment and detachment device 140 and the transporter 160 so that the substrate holder holding the substrate is transferred to the substrate attachment and detachment device 140. Thereafter, the control portion 180 controls the substrate attachment and detachment device 140 so that the holding of the substrate using the substrate holder is released. Through the aforementioned procedure, the substrate holder holding the substrate becomes the "substrate holder not holding a substrate". After the holding of the substrate using the substrate holder is released, the substrate holder may be transferred again to the plating treatment portion 150 while holding another substrate. Alternatively, after the holding of the substrate using the substrate holder is released, the substrate holder may be accommodated in the stocker 170. The substrate taken out from the substrate holder may be transferred by the substrate transfer robot 120 to the loading port 110 or the dryer 130.

<Substrate Holder>

Figure 2A:
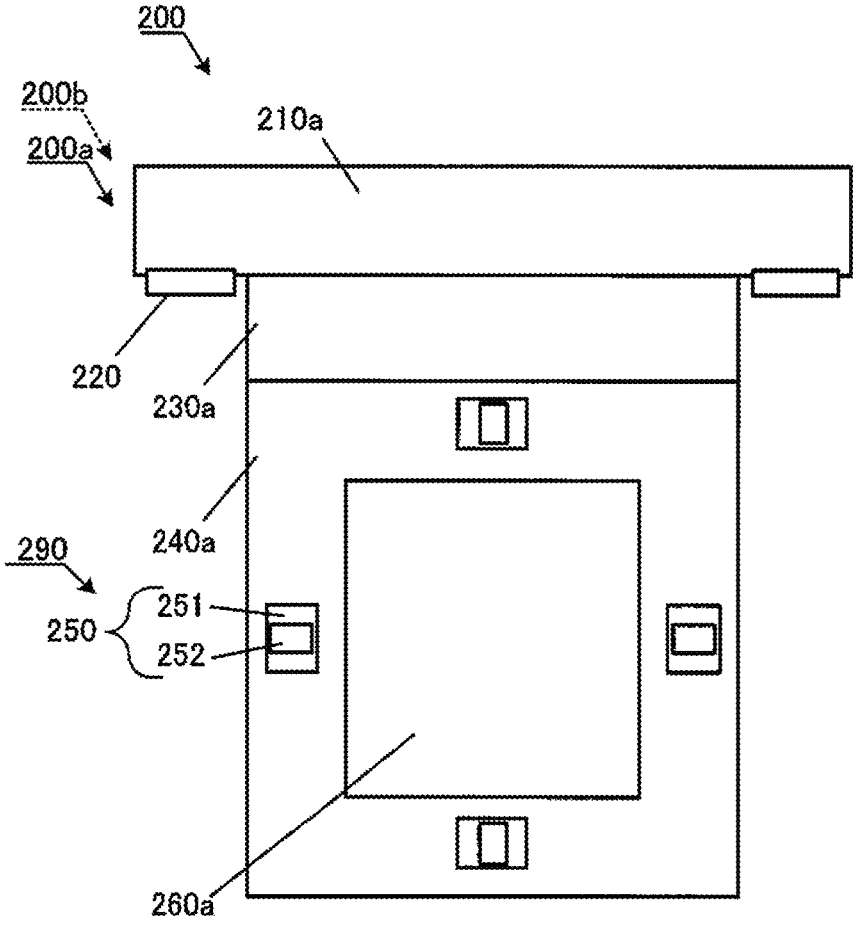
FIG. 2A is a front view of a substrate holder used in the plating apparatus according to the embodiment.
Figure 2B:
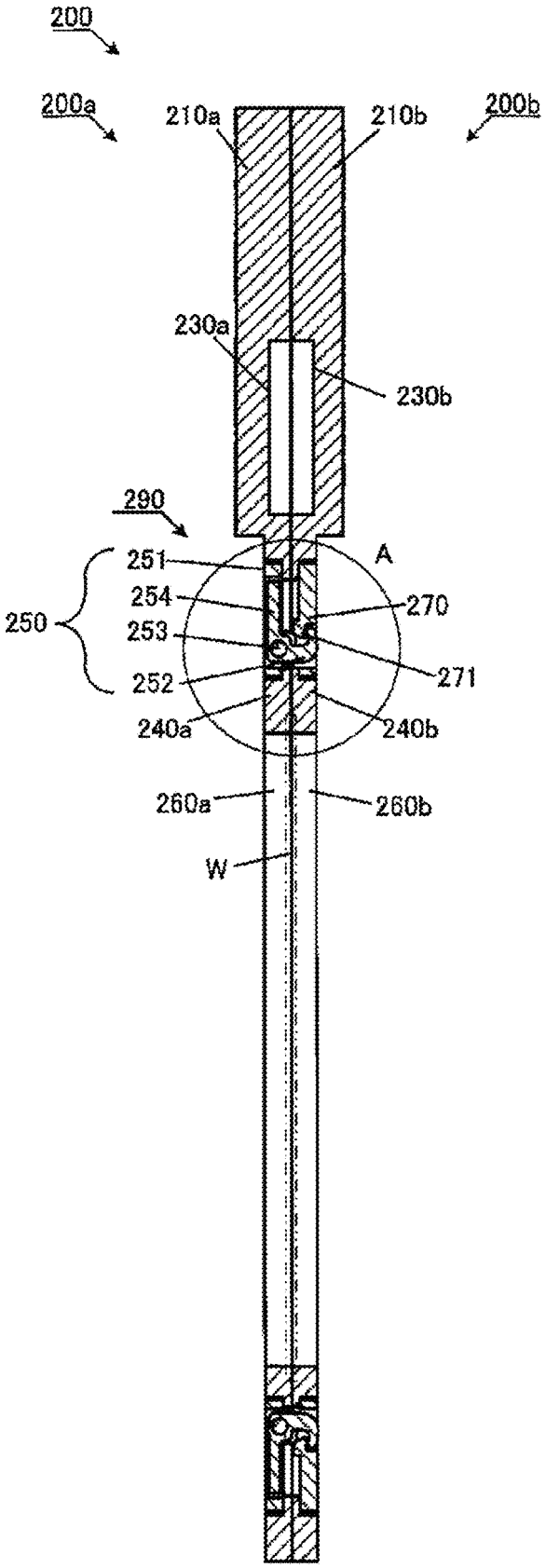
FIG. 2B is a cross-sectional view of the substrate holder used in the plating apparatus according to the embodiment.
Figure 2C:
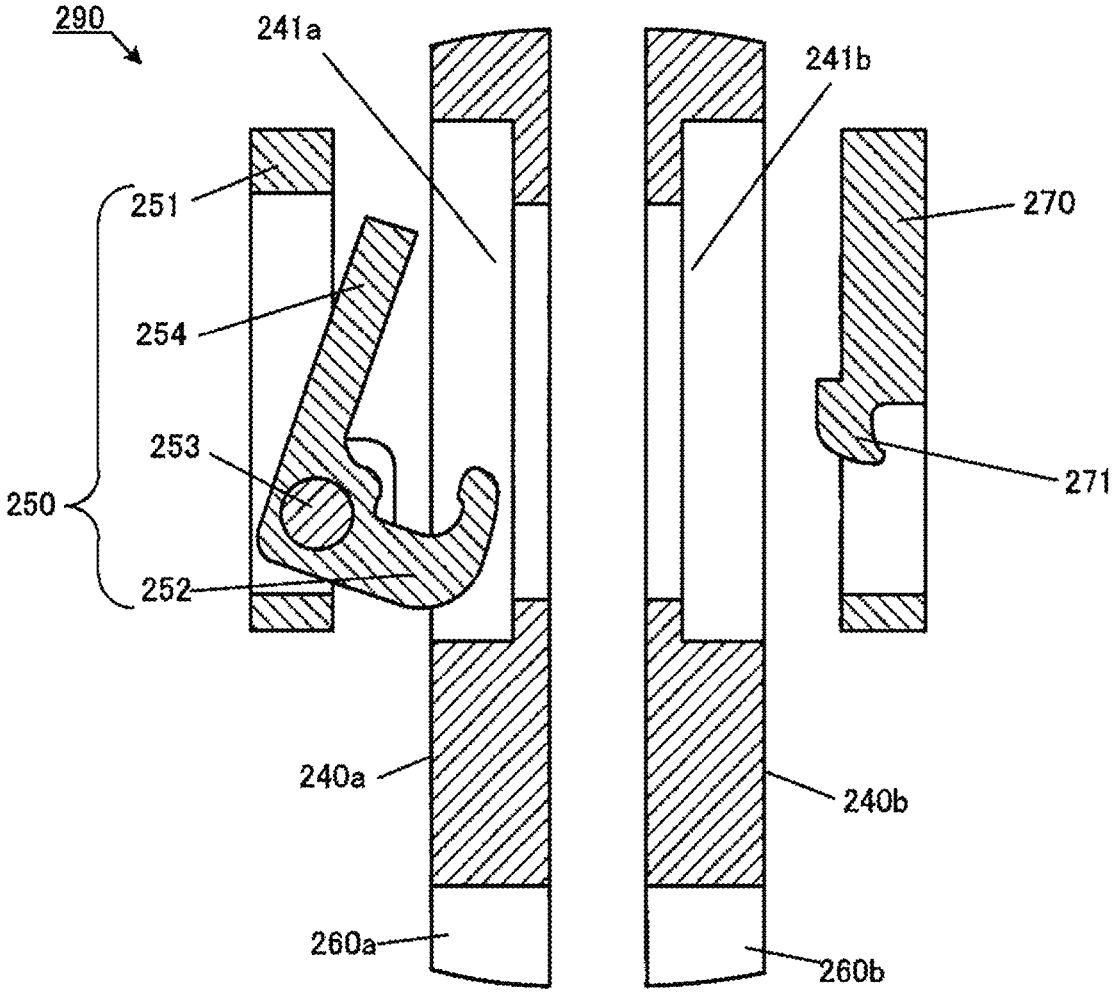
FIG. 2C is an enlarged exploded view of a portion marked with "A" in FIG. 2B.

Next, the substrate holder (hereinafter, marked with a reference numeral "200") used in the plating apparatus 100 is described. FIGS. 2A to 2C are schematic diagrams of the substrate holder 200. FIG. 2A is a front view of the substrate holder 200. FIG. 2B is a cross-sectional view of the substrate holder 200. FIG. 2C is an enlarged exploded view of a portion marked with "A" in FIG. 2B. Moreover, it should be noted that a "front surface of the plating apparatus 100 or the substrate attachment and detachment device 140" and a "front surface of the substrate holder 200" do not necessarily match.

The substrate holder 200 is a member for holding the substrate by sandwiching the substrate between frames. The substrate holder 200 includes a front frame 200*a* and a rear frame 200*b* that sandwich the substrate. The front frame 200*a* and the rear frame 200*b* are clamped by at least one clamper, preferably, a plurality of clampers 290 (the details of the clamper 290 are described later). The substrate (hereinafter, marked with a reference symbol "W") is indicated by an imaginary line in FIG. 2B.

The front frame 200*a* and the rear frame 200*b* have a symmetrical structure except for a hook portion 250 and a plate 270 to be described below. Accordingly, the terms of "front" and "rear" are merely called for the sake of convenience. Any one of a side on which the front frame 200*a* is positioned and a side on which the rear frame 200*b* is positioned may be treated as a front surface. The front frame 200*a* and the rear frame 200*b* may not be symmetrical in structure.

A holder arm 210*a* is formed at an upper portion of the front frame 200*a*. Shoulder-portion electrodes 220 may be arranged at shoulder portions of the holder arm 210*a*. In the example of FIGS. 2A to 2C, two shoulder electrodes 220 are arranged at both shoulder portions of the holder arm 210*a*. The shoulder electrodes 220 are electrically connected to substrate electrodes 320 described later by a conduction path (wiring or bus bar) not shown. Since the substrate electrodes 320 described later are electrically connected to the substrate W, the shoulder electrodes 220 are electrically connected to the substrate W. A holder arm 210*b* is arranged at the rear frame 200*b*. A configuration of the holder arm 210*b* is the same as the configuration of the holder arm 210*a*. The front frame 200*a* may include a wiring storing portion 230*a*. The rear frame 200*b* may include a wiring storing portion 230*b*.

The front frame 200*a* may further include a frame body 240*a*. The rear frame 200*b* may further include a frame body 240*b*. The frame body 240*a* and the frame body 240*b* are substantially plate-like members. An opening 260*a* and an opening 260*b* that expose the substrate W are respectively formed at central portions of each of the frame body 240*a* and the frame body 240*b*. In the example of FIGS. 2A to 2C, the opening 260*a* and the opening 260*b* have square shapes. The shapes of the opening 260*a* and the opening 260*b* may be appropriately changed if necessary. The substrate W is sandwiched between the frame body 240*a* and the frame body 240*b*.

One surface of the substrate W is exposed to the outside through the opening 260*a*. The other surface of the substrate W is exposed to the outside through the opening 260*b*. Accordingly, when the plating treatment is performed using the substrate holder 200 of FIGS. 2A to 2C, both surfaces of the substrate W come into contact with a plating solution. That is, the substrate holder 200 of FIGS. 2A to 2C is a "double-sided holder". However, the substrate holder 200 can be used for single-sided plating by covering any one of the openings or controlling electrical conditions.

The substrate holder 200 includes one clamper or a plurality of clampers 290. The clamper 290 includes the hook portion 250 attached to the frame body 240*a*, and the plate 270 attached to the frame body 240*b*. In the example of FIGS. 2A to 2C, a total of four clampers 290 are arranged.

The hook portion 250 includes a hook base 251 that is attached to the frame body 240*a*, a hook body 252, and a shaft 253 that pivotally supports the hook body 252 with respect to the hook base 251. The hook portion 250 may further include a lever 254 for pivoting the hook body 252 around the shaft 253. The hook body 252 extends toward the rear frame 200*b*. The shaft 253 extends within a plane parallel to the surface of the substrate W to be held. The hook portion 250 further includes a pressing member (not shown) for urging the hook body 252 around the shaft 253 in a counterclockwise direction of FIG. 2B or 2C to maintain the hooking of the hook body 252 to a claw 271 (described later). For example, the pressing member may be a torsion spring.

A port 241*a* (see FIG. 2C) is arranged in the frame body 240*a*. The hook portion 250 is attached to the port 241*a* through a bolt. A port 241*b* (see FIG. 2C) is arranged in the frame body 240*b*. The position and the number of the port 241*b* correspond to the position and the number of the port 241*a*. The plate 270 is attached to the port 241*b* through a bolt. The claw 271 to which the hook body 252 is hooked is arranged at the plate 270. The claw 271 extends toward the front frame 200*a*.

In the embodiment shown in FIGS. 2A to 2C, the hooking of the hook body 252 to the claw 271 is released by pushing the lever 254 toward the frame body 240*b*. Alternatively, the lever 254 may be configured so that the hooking is released by pulling the lever 254 to the front side.

In FIGS. 2A to 2C, the hook portion 250 is attached to the front frame 200*a*, and the plate 270 is attached to the rear frame 200*b*. Alternatively, the hook portion 250 may be attached to the rear frame 200*b*, and the plate 270 may be attached to the front frame 200*a*.

Figure 3:
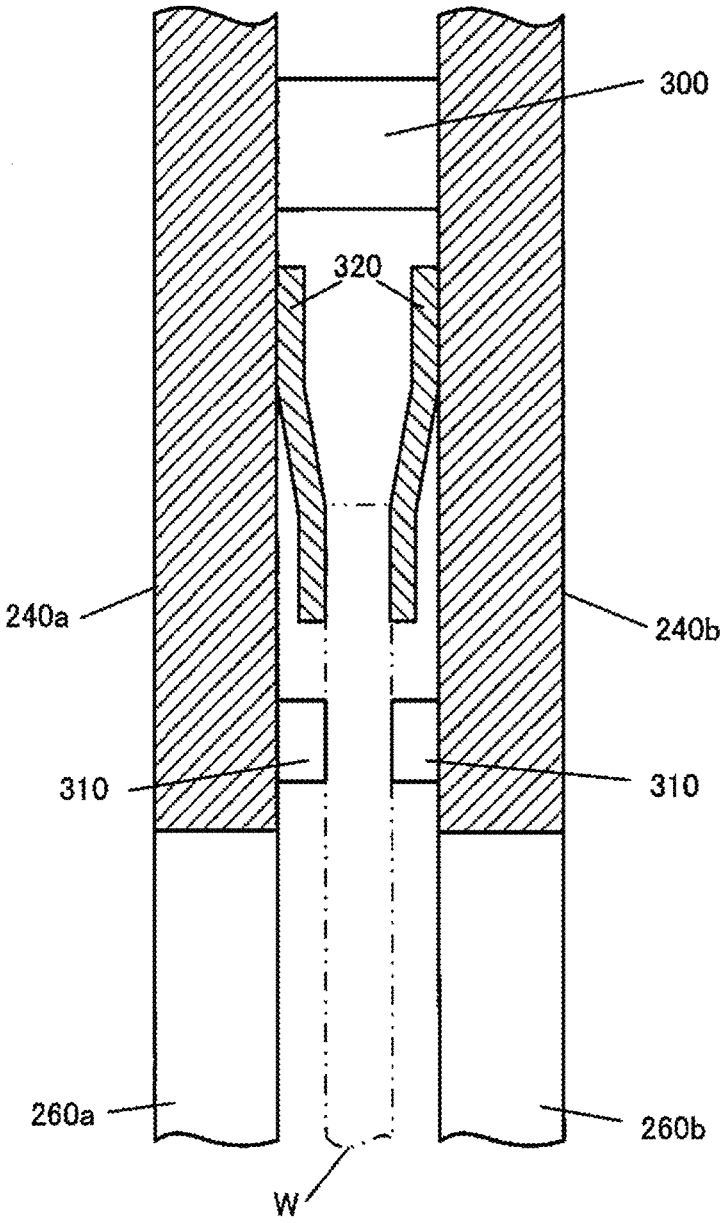
FIG. 3 is a cross-sectional view of a portion of the substrate holder at which a substrate is held.

Next, the details of a portion of the substrate holder 200 which holds the substrate W is described with reference to FIG. 3. FIG. 3 is a cross-sectional view of the portion of the substrate holder 200 which holds the substrate W. It is necessary to supply an electrical power to both surfaces of the substrate W in order to perform the plating treatment on both surfaces of the substrate W. Thus, the substrate electrodes 320 are respectively arranged at the frame body 240*a* and the frame body 240*b* in FIG. 3. The substrate electrodes 320 are electrically connected to the surfaces of the substrate W, respectively. The substrate electrodes 320 are electrically connected to the shoulder electrodes 220. Accordingly, the electrical power supplied to the shoulder electrodes 220 is supplied to the substrate W through the substrate electrodes 320.

The substrate holder 200 includes an outer seal 300 and inner seals 310 for sealing a space in which the substrate electrodes 320 are present from the plating solution. The outer seal 300 is configured to seal a gap between the frame body 240*a* and the frame body 240*b* on outside the substrate W. The outer seal 300 may be arranged at the frame body 240*a*, or be arranged at the frame body 240*b*. The inner seals 310 are respectively arranged at the frame body 240*a* and the frame body 240*b*. The inner seals 310 come into contact with the substrate W when the substrate W is held. The outer seal 300 and the inner seals 310 can elastically deform in a thickness direction of the substrate W. The substrate W is held between the frame body 240*a* and the frame body 240*b* by a contact pressure between the inner seals 310 and the substrate W. It should be noted that FIG. 3 is merely a schematic diagram and may be different from the actual configuration. For example, the substrate holder 200 may include a seal holder for holding the outer seal 300 and the inner seals 310.

<Substrate Attachment and Detachment Device>

In order to sandwich the substrate W between the frame body 240*a* and the frame body 240*b*, it is necessary to hook the hook body 252 to the claw 271. When the hook body 252 is hooked to the claw 271, the frame body 240*a* and the frame body 240*b* are restrained from being separated from each other, the outer seal 300 and the inner seals 310 elastically deform in the thickness direction of the substrate W, and a seal pressure is generated. In order to hook the hook body 252 to the claw 271, it is necessary for the hook body 252 to be temporarily positioned closer to the back side (right direction in FIG. 2C) than the claw 271. Accordingly, in order to hold the substrate W by the substrate holder 200, it is necessary to push the frame body 240*a* toward the frame body 240*b* or push the frame body 240*b* toward the frame body 240*a*.

As stated above, the outer seal 300 and the inner seals 310 are present between the frame body 240*a* and the frame body 240*b*. Accordingly, when the frame body 240*a* and/or the frame body 240*b* are/is pushed, reaction force from the outer seal 300 and the inner seals 310 is generated. The substrate attachment and detachment device 140 according to the embodiment is configured to be capable of pushing the frame body 240*a* and/or the frame body 240*b* against the reaction force from the outer seal 300 and the inner seals 310. The substrate attachment and detachment device 140 is configured to be capable of further hooking the hook body 252 to the claw 271 (pivot the hook body 252) in a state that the frame body 240*a* and/or the frame body 240*b* are/is pushed. The substrate attachment and detachment device 140 can hold the substrate W in the substrate holder 200 through these operations. The details of the substrate attachment and detachment device 140 are described below.

Figure 4A:
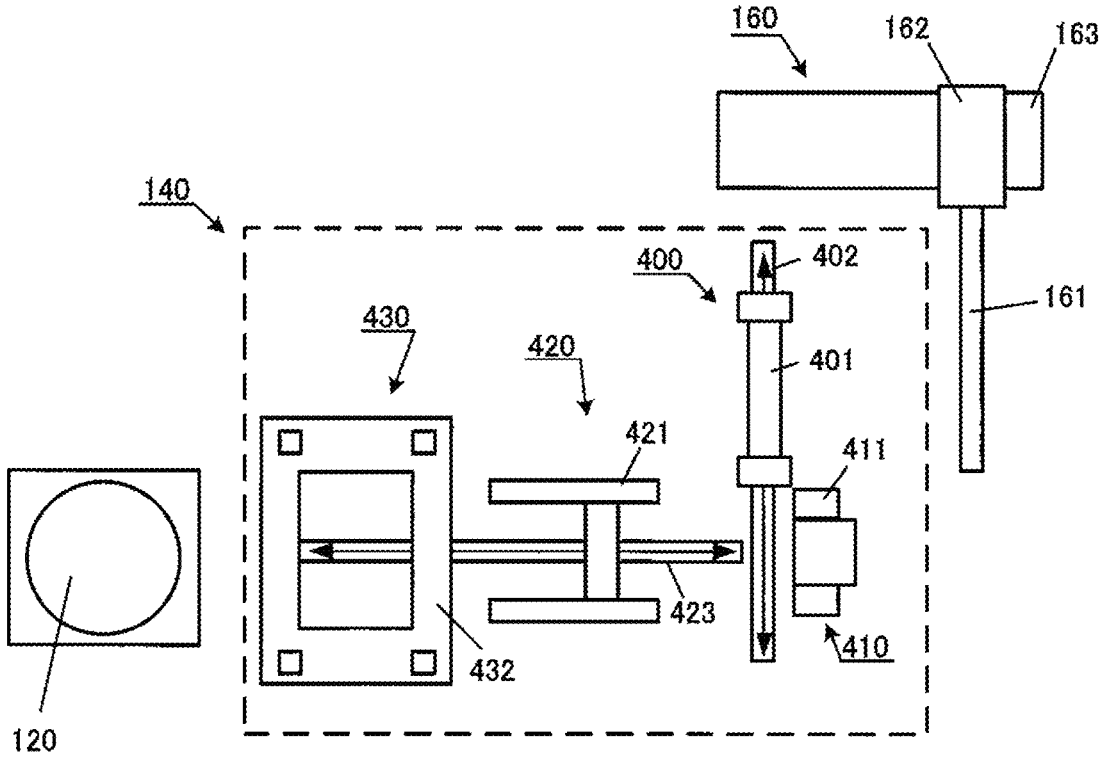
FIG. 4A is a top view of a substrate attachment and detachment device according to an embodiment.
Figure 4B:
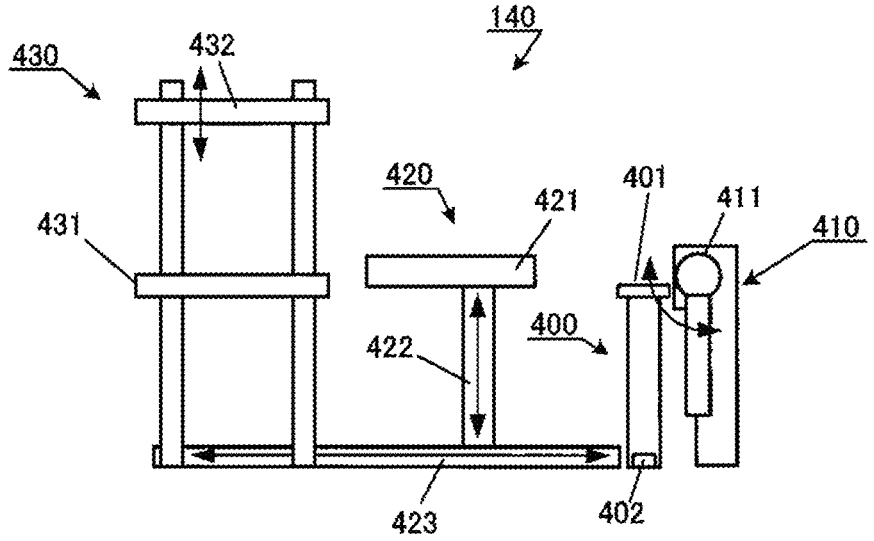
FIG. 4B is a front view of the substrate attachment and detachment device according to the embodiment.

FIGS. 4A and 4B are schematic diagrams of the substrate attachment and detachment device 140 according to the embodiment. FIG. 4A is a top view of the substrate attachment and detachment device 140. FIG. 4B is a front view of the substrate attachment and detachment device 140. In FIG. 4A, the substrate transfer robot 120 and the transporter 160 are also shown.

The substrate attachment and detachment device 140 includes a holder reception portion 400, a holder tilting portion 410, a holder transfer portion 420, and a pressing portion 430. The pressing portion 430 may also be referred to as a "fixing portion" or a "substrate attachment and detachment portion". The transporter 160 is configured to be capable of accessing the holder reception portion 400. The substrate W is loaded into the substrate attachment and detachment device 140, more specifically, the pressing portion 430 by the substrate transfer robot 120, and is unloaded from the substrate attachment and detachment device 140, more specifically, the pressing portion 430 by the substrate transfer robot 120.

The holder receiving section 400 includes a holder reception body 401, and a holder reception linear movement mechanism 402 that moves the holder reception body 401. The holder reception body 401 receives the substrate holder 200 from the transporter 160. Thereafter, the holder reception body 401 is moved to near the holder tilting portion 410 by the holder reception linear movement mechanism 402.

Figure 5A:
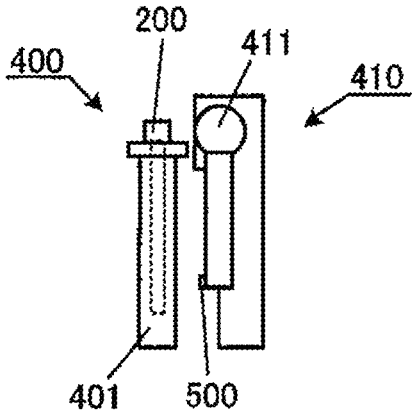
FIG. 5A is a front view of a holder tilting portion before the substrate holder is received.
Figure 5B:
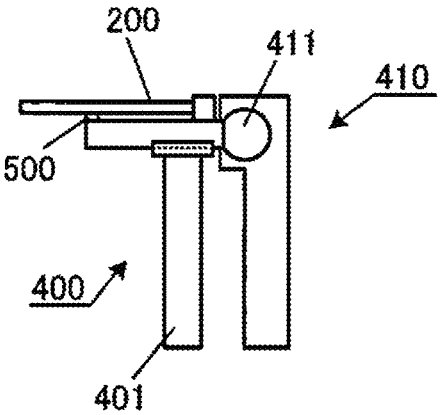
FIG. 5B is a front view of the holder tilting portion after the substrate holder is received.

The holder tilting portion 410 includes a holder-tilting-portion arm 411. As shown in FIG. 5A, the holder-tilting-portion arm 411 is initially turned directly downwards. As shown in FIG. 5B, the holder-tilting-portion arm 411 tilts until being horizontal, and thereby the holder-tilting-portion arm 411 receives the substrate holder 200 from the holder reception body 401. The substrate holder 200 is tilted by the tilting of the holder-tilting-portion arm 411 until the substrate holder becomes horizontal (the substrate holder 200 vertically directed becomes horizontally directed). The holder-tilting-portion arm 411 may include a pin 500 that supports the substrate holder 200 and prevents the substrate holder 200 from falling. The pin 500 may be storable. The specific structure, arrangement, and number of the pin 500 may be appropriately determined. The substrate holder 200 may include a pin hole (not shown) corresponding to the pin 500.

Figure 6A:
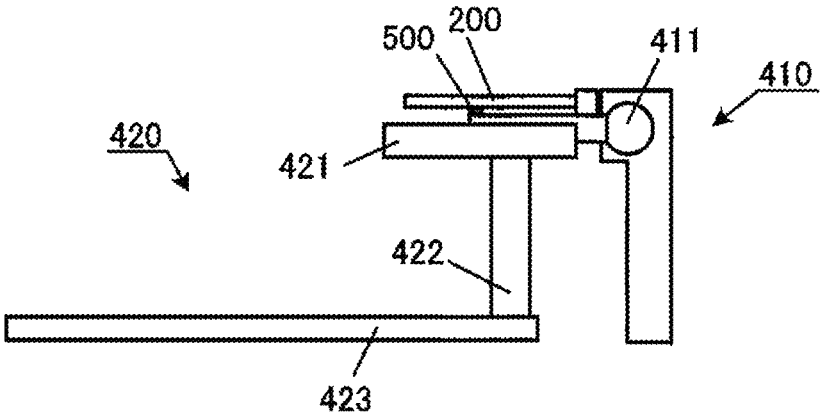
FIG. 6A is a front view of a holder transfer portion before the substrate holder is received.
Figure 6B:
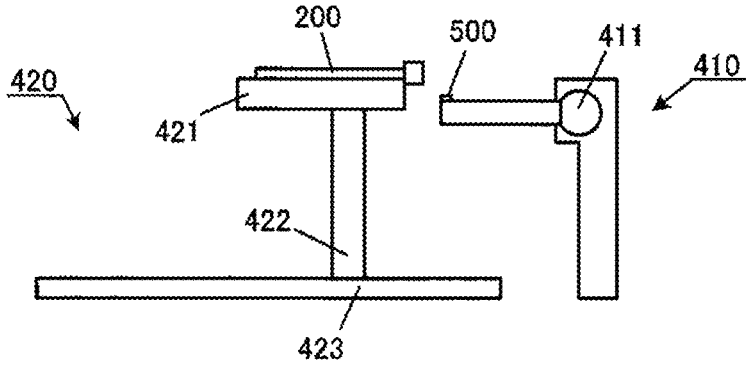
FIG. 6B is a front view of the holder transfer portion that is transferring the substrate holder to a pressing portion.

The holder transfer portion 420 includes a holder carrier 421, a carrier vertical movement mechanism 422 that vertically moves the holder carrier 421, and a transfer-portion linear movement mechanism 423 that moves the carrier vertical movement mechanism 422 toward the pressing portion 430. As shown in FIGS. 6A and 6B, the holder carrier 421 receives the substrate holder 200 from a lower portion of the holder-tilting-portion arm 411, and transfers the substrate holder 200 toward the pressing portion 430.

The pressing portion 430 includes a stage 431 on which the substrate holder 200 is horizontally mounted and a pressing unit 432. The stage 431 is configured to receive the substrate holder 200 from the holder transfer portion 420. The stage 431 is further configured to deliver the substrate holder 200 to the holder transfer portion 420. The pressing unit 432 is disposed above the stage 431. The pressing unit 432 is configured to be capable of moving vertically. The pressing unit 432 can press the substrate holder 200 on the stage 431 downwards.

Figure 7A:
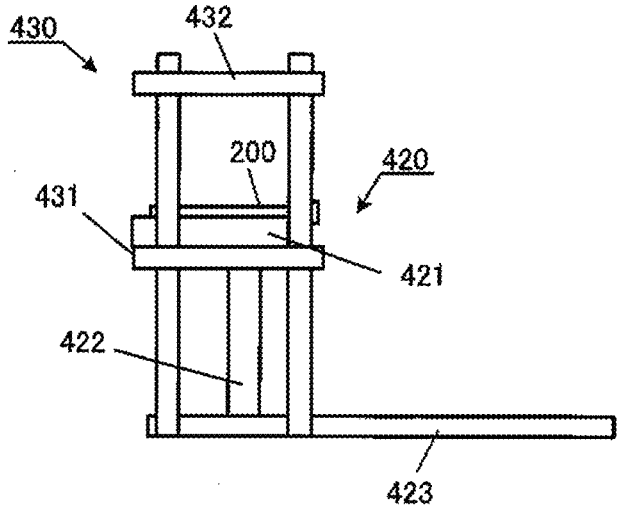
FIG. 7A is a front view of the pressing portion before the substrate holder is received.
Figure 7B:
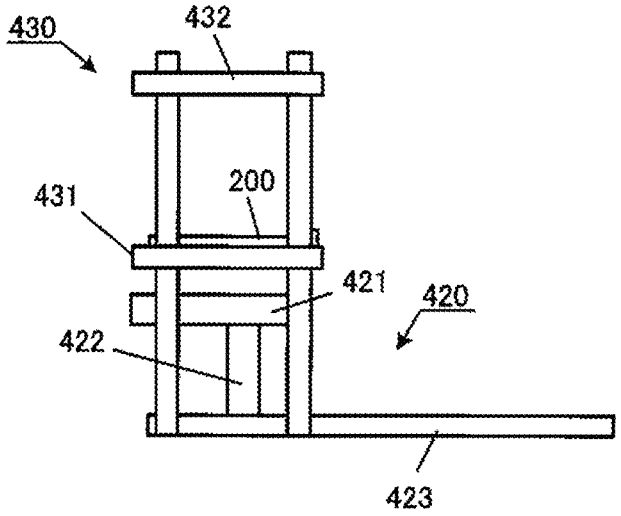
FIG. 7B is a front view of the pressing portion after the substrate holder is received.

The movement of the holder transfer portion 420 and the pressing portion 430 is described with reference to FIGS. 7A to 7C. First, a height of the holder carrier 421 is adjusted by the carrier vertical movement mechanism 422 to a height appropriate to deliver the substrate holder 200 to the stage 431. Thereafter, the holder carrier 421 is loaded into the pressing portion 430 by the transfer-portion linear movement mechanism 423 (FIG. 7A). Subsequently, the holder carrier 421 is lowered by the carrier vertical movement mechanism 422 (FIG. 7B). By lowering the holder carrier 421, the substrate holder 200 is mounted on the stage 431.

Figure 7C:
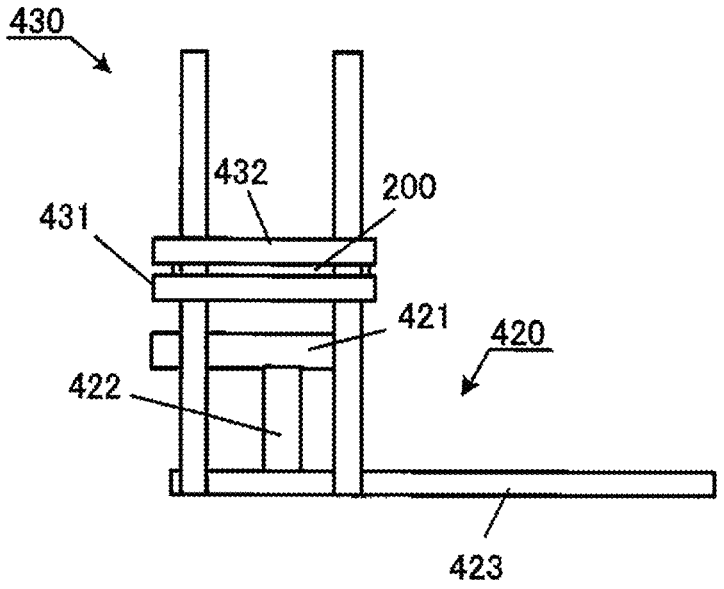
FIG. 7C is a front view of the pressing portion that presses the substrate holder downwards.

Subsequently, the pressing unit 432 is lowered toward the substrate holder 200 on the stage 431 (FIG. 7C). The substrate holder 200 is pressed by the pressing unit 432, and thereby the hook body 252 and the claw 271 are positioned at a position at which the hook body 252 can be hooked to the claw 271 or the hooking of the hook body 252 to the claw 271 can be released (see FIGS. 2A to 2C for the hook body 252 and the claw 271).

It should be noted that the configuration of the substrate attachment and detachment device 140 that is shown is merely an example. For example, the holder tilting portion 410 is not required as long as the substrate holder 200 can be made horizontal by the transporter 160. For example, elements other than the pressing portion 430 are not required as long as the transporter 160 can directly transfer the substrate holder 200 to the pressing portion 430. The specific configuration of the substrate attachment and detachment device 140 may be appropriately determined. When the substrate holder 200 mounted on the stage 431 is transferred to the transporter 160, the processes are performed in the reverse procedure of the procedure described with reference to FIGS. 5A to 7C.

<Configuration of Pressing Portion>

Figure 8A:
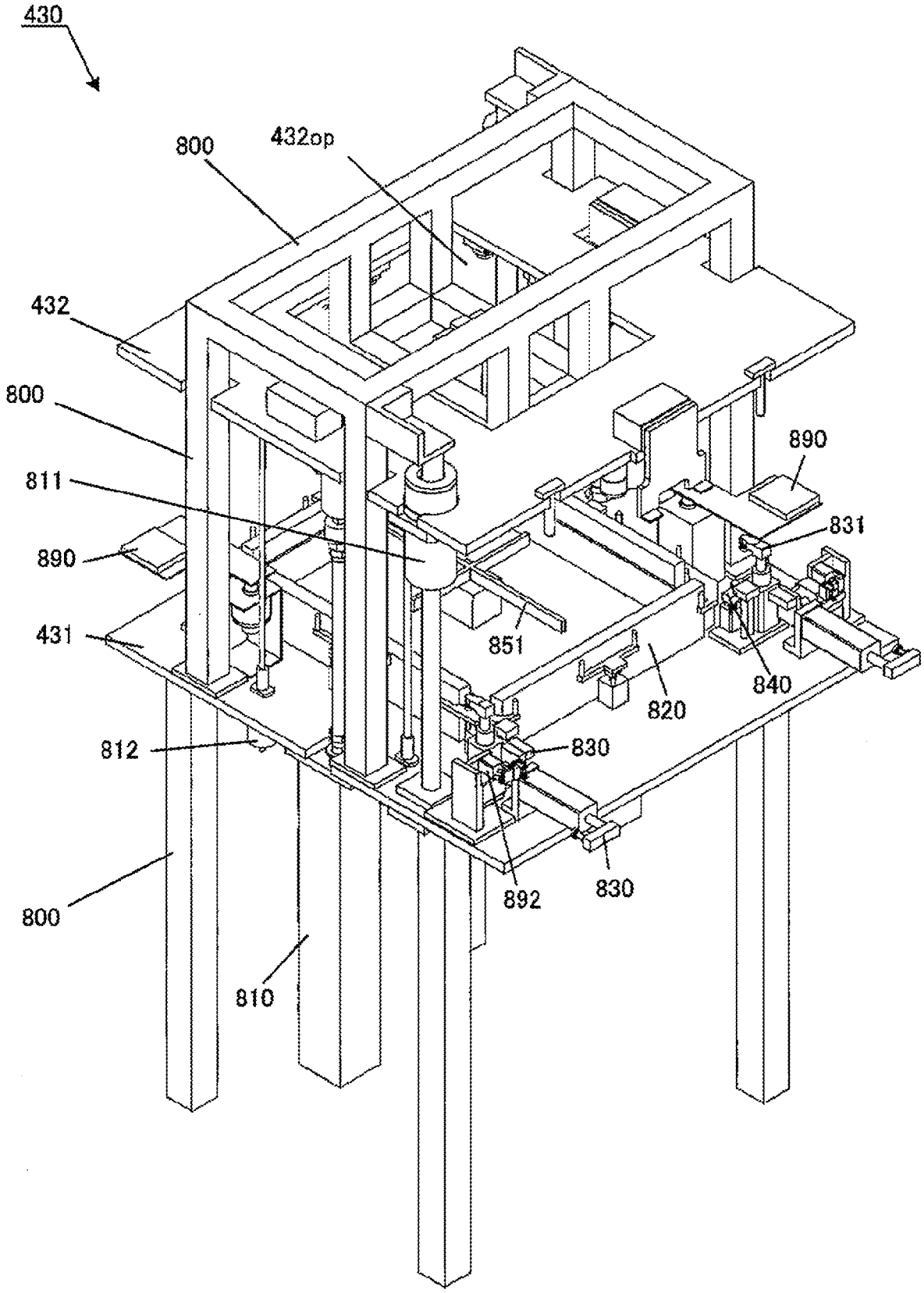
FIG. 8A is a perspective view of the pressing portion when viewed from above.
Figure 8B:
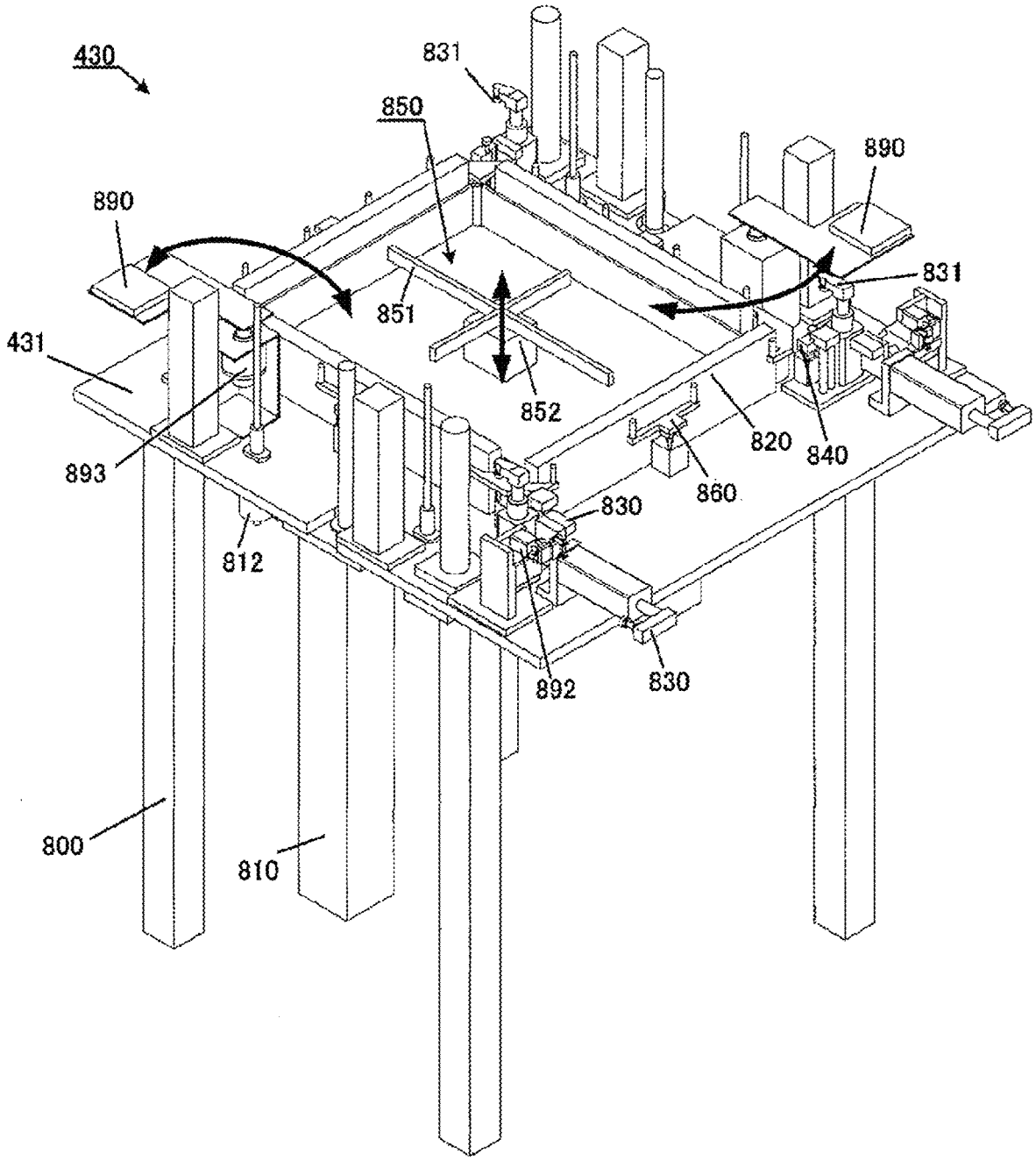
FIG. 8B is a perspective view of the pressing portion when viewed from above, in which the pressing portion of FIG. 8B is cut out at a position slightly higher than a light source.
Figure 8C:
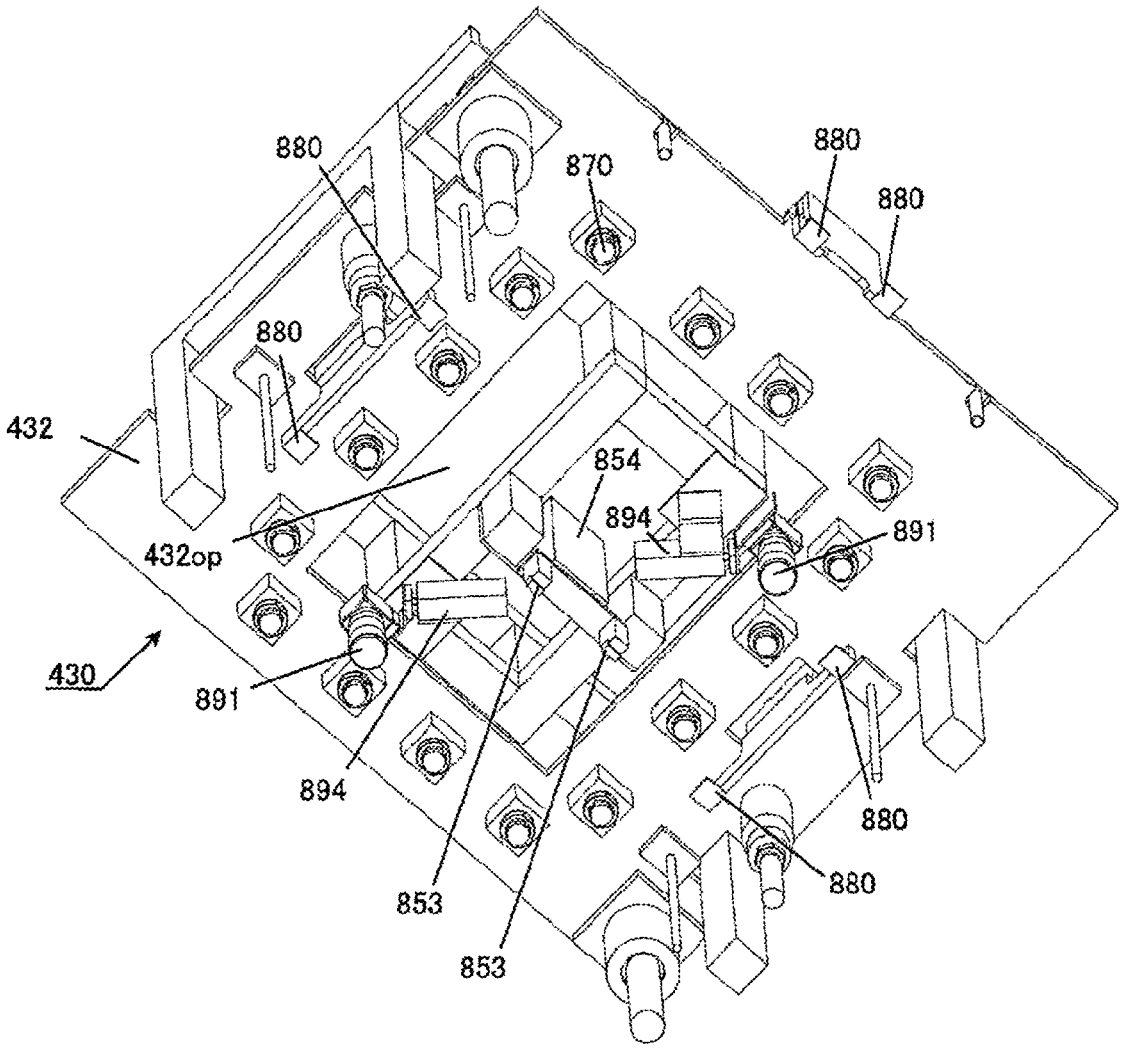
FIG. 8C is a perspective view of the pressing portion when viewed from below, in which the pressing portion of FIG. 8C is cut out at a position which is lower than a pressing unit and higher than a stage.

The details of the pressing portion 430 are described with reference to FIGS. 8A to 8C. FIG. 8A is a perspective view of the pressing portion 430 when viewed from above. FIG. 8B is a perspective view of the pressing portion 430 when viewed from above. The pressing portion 430 of FIG. 8B is cut out at a position slightly higher than a light source 890. FIG. 8C is a perspective view of the pressing portion 430 when viewed from below. The pressing portion 430 of FIG. 8C is cut out at a position which is lower than the pressing unit 432 and higher than the stage 431.

The pressing portion 430 includes a housing 800. In the example of FIGS. 8A to 8C, the housing 800 is made of a metal bar. The stage 431 is attached to the housing 800. The stage 431 is substantially parallel to a horizontal plane. A pressing-unit vertical movement mechanism 810 is arranged at the stage 431. The pressing unit 432 is vertically moved by the pressing-unit linear movement mechanism 810. The pressing-unit vertical movement mechanism 810 may include, for example, an air cylinder, or may include, for example, a combination of a ball screw and a motor. A linear movement guide 811 and a brake 812 are further arranged at the stage 431. The brake 812 may also be referred to as a "linear clamper", a "linear guide clamper" or the like. The linear movement guide 811 extends upwards from the stage 431 and guides the vertical movement of the pressing unit 432. The brake 812 can stop the pressing unit 432 at any location. The configurations of the pressing-unit vertical movement mechanism 810, the linear movement guide 811, and the brake 812 may be any configurations as long as these components can endure the weight of the pressing unit 432.

A frame-like (window-frame-like) mounting unit 820 is arranged at a substantially center of the stage 431. The specific shape of the mounting unit 820 may be determined by the shapes of the substrate W and the substrate holder 200. The substrate holder 200 is mounted on the mounting unit 820. The mounting unit 820 is configured to come into contact with the substrate holder 200 (specifically, for example, the front frame 200*a*) but not come into contact with the substrate W.

The stage 431 may include positioning mechanisms 830 and fixing clamps 831. The positioning mechanisms 830 two-dimensionally or one-dimensionally position the substrate holder 200 to be mounted or already mounted on the mounting unit 820 by horizontally pushing the substrate holder 200. The specific arrangement, shape, and other characteristics of the positioning mechanism 830 are determined by the shape, size and the like of the substrate holder 200. The fixing clamps 831 fix the frame positioned on the lower side by sandwiching the frame (the front frame 200*a* in the example of FIGS. 9A to 9M) positioned on the lower side.

The stage 431 further includes a frame pusher 840. The frame pusher 840 lifts the frame (the rear frame 200*b* in the example of FIGS. 9A to 9M) of the frames of the substrate holder 200 which is positioned on the upper side. The specific arrangement, shape, and other characteristics of the frame pusher 840 are determined by the shape, size and the like of the substrate holder 200. Operations of the frame pusher 840 are described later.

The pressing portion 430 further includes a substrate supporting unit 850 that sandwiches the substrate W between the front frame 200*a* and the rear frame 200*b*. The substrate supporting unit 850 may include a lower substrate supporter 851, a lower-substrate-supporter vertical movement mechanism 852, an upper substrate supporter 853, and an upper-substrate-supporter vertical movement mechanism 854.

The lower substrate supporter 851 is arranged at the stage 431. The lower substrate supporter 851 is a member that supports the substrate W from below. Specifically, the lower substrate supporter 851 is disposed within a frame defined by the mounting unit 820. The lower substrate supporter 851 comes into contact with the substrate W through the opening (for example, the opening 260*a*) of the frame positioned on the lower side. A contactable region of the substrate W is a preset region, and is, for example, a region of the substrate Win which the wiring is not formed. Thus, the lower substrate supporter 851 is formed so as to come into contact with only the contactable region of the substrate W. For example, the lower substrate supporter 851 has a cross shape in the example of FIGS. 8A to 8C. The lower substrate supporter 851 is configured to be capable of being vertically moved by the lower-substrate-supporter vertical movement mechanism 852. Preferably, the lower-substrate-supporter vertical movement mechanism 852 is a pneumatic mechanism. However, the lower-substrate-supporter vertical movement mechanism 852 other than the pneumatic mechanism may also be used. The lower-substrate-supporter vertical movement mechanism 852 may be, for example, a motor.

The upper substrate supporter 853 is disposed above the stage 431. In the example of FIGS. 8A to 8C, the upper substrate supporter 853 is attached to the housing 800. More specifically, the pressing unit 432 of FIGS. 8A to 8C includes a pressing unit opening 432*op*, and the upper substrate supporter 853 is configured to be capable of accessing the substrate W through the pressing unit opening 432*op*. The upper substrate supporter 853 is a member that supports the substrate W from above. The upper substrate supporter 853 sandwiches the substrate W in cooperation with the lower substrate supporter 851. Furthermore, the upper substrate supporter 853 comes into direct contact with the substrate W through the opening (for example, the opening 260*b*) of the frame positioned on the upper side. Thus, the upper substrate supporter 853 is also formed so as to come into contact with only the contactable region of the substrate W. It should be noted that the contactable region of the substrate W may be different depending on the surface of the substrate. Accordingly, the shape of the upper substrate supporter 853 may be different from the shape of the lower substrate supporter 851. The upper substrate supporter 853 of FIGS. 8A to 8C has, for example, a reverse U-shape, and comes into contact with the substrate W at two points. The upper substrate supporter 853 is configured to be capable of being vertically moved by the upper-substrate-supporter vertical movement mechanism 854. Preferably, the upper-substrate-supporter vertical movement mechanism 854 is also a pneumatic mechanism. However, the upper-substrate-supporter vertical movement mechanism 854 other than the pneumatic mechanism may also be used.

When the frame positioned on the upper side is lifted, the substrate supporting unit 850 can move the substrate W. In the following description, it is assumed that the front frame 200*a* is positioned on the lower side and the rear frame 200*b* is positioned on the upper side. Specifically, the substrate supporting unit 850 moves the substrate W between a first position (see FIG. 9C) at which the substrate can be sandwiched by the front frame 200*a* and the rear frame 200*b* and a second position (see FIG. 9J) at which the substrate W can be unloaded from the substrate attachment and detachment device 140. The second position is a position higher than the first position. Typically, the first position is a position at which a lower surface of the substrate W and an upper surface (surface facing the rear frame 200*b*) of the front frame 200*a* are substantially in the same plane.

The pressing unit 432 is approximately a plate-like member. Pressing mechanisms 870 are arranged on a lower surface of the pressing unit 432. The pressing mechanisms 870 are mechanisms that press the substrate holder 200 in order to compress the outer seal 300 and the inner seals 310 of the substrate holder 200. More accurately, the pressing mechanisms 870 press the rear frame 200*b* toward the stage 431, that is, press the rear frame downwards. The pressing mechanisms 870 may be constituted by, for example, an air cylinder and a piston capable of moving vertically. The pressing mechanisms 870 may include a motor. The outer seal 300 and the inner seals 310 are compressed by the pressing mechanisms 870; as a result, the hook body 252 of the clamper 290 can be hooked to the claw 271. The pressing unit 432 may include a plurality (16 in FIGS. 8A to 8C) of pressing mechanisms 870 in order to uniformly compress the outer seal 300 and the inner seals 310. Preferably, the pressing mechanisms 870 are disposed approximately directly above these seals in order to compress the outer seal 300 and the inner seals 310. In the example shown in the diagrams, the substrate W has a rectangular shape. Thus, the seals also have rectangular shapes. Accordingly, the pressing mechanisms 870 are arranged in a rectangular shape in the example of FIGS. 8A to 8C. The specific number, position, and size of the pressing mechanisms 870 and the strength with which the pressing mechanisms 870 press the frame of the substrate holder 200 may be determined according to the characteristics of the substrate holder 200.

A clamper opener 860 is further arranged at the stage 431. The clamper 290 of the substrate holder 200 is configured to be "normally closed". The clamper opener 860 opens the clamper 290 by pushing the clamper 290. More accurately, the clamper opener 860 pivots the hook body 252 around the shaft 253 by pushing the lever 254 (see FIGS. 2A to 2C). When the clamper 290 is opened, the hook body 252 can be hooked to the claw 271, and the hooking of the hook body 252 to the claw 271 can be released. The number, arrangement, and other characteristics of the clamper opener 860 are determined depending on the number, size and the like of the clamper 290. The clamper opener 860 of FIGS. 8A to 8C operates two clampers 290 by one actuator.

Frame lifting claws 880 are arranged at the pressing unit 432. The frame lifting claw 880 is configured to be capable of expanding and contracting within a plane parallel to the substrate W. The frame lifting claws 880 are arranged for hooking and lifting the rear frame 200*b*. Preferably, the pressing unit 432 includes three or more frame lifting claws 880 in order to support the substrate holder 200 at three points. In FIG. 8C, six frame lifting claws 880 are shown, and two frame lifting claws 880 are paired as one set. The pressing unit 432 may be configured to be capable of lifting the frame by means other than the claw. Examples of the means other than the claw include an electromagnet and an adsorption element.

The substrate attachment and detachment device 140 may further include at least one set of a light source 890 and a camera 891. The light source 890 and the camera 891 are used when the substrate W is transferred to the substrate attachment and detachment device 140 by the substrate transfer robot 120. Specifically, the light source 890 and the camera 891 are used for adjusting the position and/or angle of the substrate W. The light source 890 is attached to the stage 431. Specifically, the light source 890 is arranged on outside the mounting unit 820. The light source 890 is configured to be capable of being pivoted (rotatably moved) by a light source actuator 893. A pivot axis of the light source 890 is along a vertical direction. Through the pivoting, the light source 890 moves between a light source waiting position at which the attachment and detachment of the substrate W are not inhibited and an irradiation position at which the light can be irradiated on corners of the substrate W gripped by the substrate transfer robot 120. However, the light source 890 may be moved by means other than pivoting, for example, by linear movement.

The camera 891 is attached to the housing 800 or the upper-substrate-supporter vertical movement mechanism 854. In the example of FIGS. 8A to 8C, the camera 891 is attached to the housing 800. The camera 891 is configured to be capable of being horizontally moved by a camera actuator 894. Specifically, the camera actuator 894 moves the camera 891 between a camera waiting position and an imaging position. The camera waiting position is a position at which the attachment and detachment of the substrate W are not inhibited and a position within the opening 260*b* so as not to interfere with the raising and lowering of the rear frame 200*b*. The imaging position is a position facing the irradiation position. The imaging position is a position at which images of the corners of the substrate W irradiated by the light source can be captured. The camera 891 may be moved by means other than horizontal movement, for example, pivoting. The specific operations of the light source 890 and the camera 891 are described later.

The pressing portion 430 may further include an energization sensor 892. The energization sensor 892 is a sensor for checking energization between the substrate holder 200 and the substrate W. The energization sensor 892 is configured to be capable of coming into contact with the shoulder electrodes 220. The energization sensor 892 may be stored by a motor or a pneumatic mechanism not shown.

Moreover, in FIGS. 8A to 8C, the components attached to the stage 431 may be components independent of the stage 431 (however, except for the mounting unit 820). That is, the description of "the stage 431 includes a component A" may be replaced by "the pressing portion 430 includes a component A". The specific configuration of the substrate attachment and detachment device 140 may be appropriately determined. In the above, the case that the frame body 240*a* including the hook portion 250 is positioned on the lower side is described as an example. However, for example, the clamper opener 860 may be arranged at the pressing unit 432 instead of at the stage 431 as long as the hook portion 250 is attached to the frame body 240*b*.

<Operation of Pressing Portion>

Figure 9A:
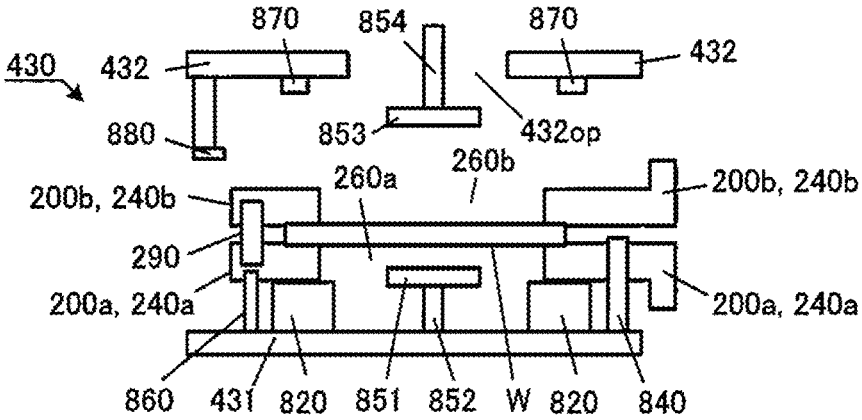
FIG. 9A is a schematic diagram of the pressing portion at a first point of time (hereinafter, simply referred to as an "n-th point of time") of an operation for releasing the holding of the substrate using the substrate holder.

Next, operations of the pressing portion 430 are described with reference to FIGS. 9A to 9M. In FIGS. 9A to 9M, the operations of the pressing portion 430 for releasing the holding of the substrate W using the substrate holder 200 are described as an example. It should be noted that FIGS. 9A to 9M merely show the basic principle of the operations of the pressing portion 430 and the dimensions, shapes, and arrangements of elements shown in FIGS. 9A to 9M are not accurate. FIGS. 9A to 9M are described in a sequence of time. In FIG. 9A, all the components that are shown are marked with reference symbols. Meanwhile, in FIGS. 9B to 9M, only the components that operate at the corresponding point of time are marked with reference symbols. In the description of FIGS. 9A to 9M, the front frame 200*a* may be regarded as the frame body 240*a*, and the rear frame 200*b* may be regarded as the frame body 240*b*.

In FIGS. 9A to 9M, the substrate W is moved between the first position and the second position by the substrate supporting unit 850. The first position is a position at which the substrate can be sandwiched by the front frame 200*a* and the rear frame 200*b* (FIGS. 9C to 9I). The second position is a position at which the substrate W can be unloaded from the substrate attachment and detachment device 140 (FIGS. 9J and 9K). The second position is higher than the first position.

FIG. 9A is a schematic diagram of the pressing portion 430 at a first point of time (hereinafter, simply referred to as an "n-th point of time) of the operation for releasing the holding of the substrate W using the substrate holder 200. At the first point of time, the substrate holder 200 is mounted on the mounting unit 820, and the pressing unit 432 is lifted. That is, FIG. 9A corresponds to FIG. 7B. At the first point of time, the positioning mechanisms 830 (not shown in FIGS. 9A to 9M) and the fixing clamps 831 may be operated.

Figure 9B:
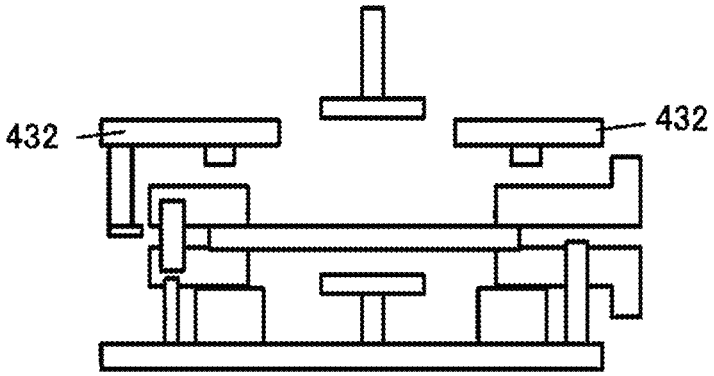
FIG. 9B is a schematic diagram of the pressing portion at a second point of time.

FIG. 9B is a schematic diagram of the pressing portion 430 at a second point of time. At the second point of time, the pressing unit 432 is lowered by the pressing-unit vertical movement mechanism 810 (not shown in FIGS. 9A to 9M). The pressing unit 432 is lowered to a position at which the pressing mechanisms 870 can push the rear frame 200*b*. After the pressing unit 432 is lowered to an appropriate position, the brake 812 (not shown in FIGS. 9A to 9M) operates, and the position of the pressing unit 432 is fixed.

Figure 9C:
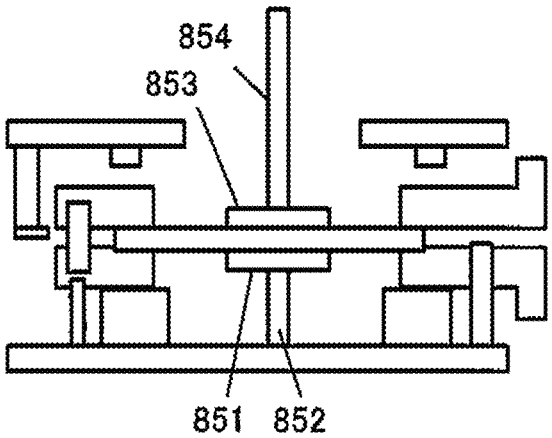
FIG. 9C is a schematic diagram of the pressing portion at a third point of time.

FIG. 9C is a schematic diagram of the pressing portion 430 at a third point of time. At the third point of time, the substrate supporting unit 850 operates. That is, at the third point of time, the lower substrate supporter 851 is raised by the lower-substrate-supporter vertical movement mechanism 852. Furthermore, at the third point of time, the upper substrate supporter 853 is lowered by the upper-substrate-supporter vertical movement mechanism 854. As a result, at the third point of time, the substrate W is sandwiched by the lower substrate supporter 851 and the upper substrate supporter 853. The substrate W is attached to the substrate holder 200 or detached from the substrate holder 200 at the position shown in FIG. 9C. That is, the substrate is sandwiched by the front frame 200*a* and the rear frame 200*b*, or the sandwiching of the substrate is released by separating the front frame 200*a* and the rear frame 200*b* from each other. Accordingly, the position of the substrate W shown in FIG. 9C becomes the "first position". The raising of the lower substrate supporter 851 and the lowering of the upper-substrate-supporter vertical movement mechanism 854 may be simultaneously performed or be performed in turn.

Figure 9D:
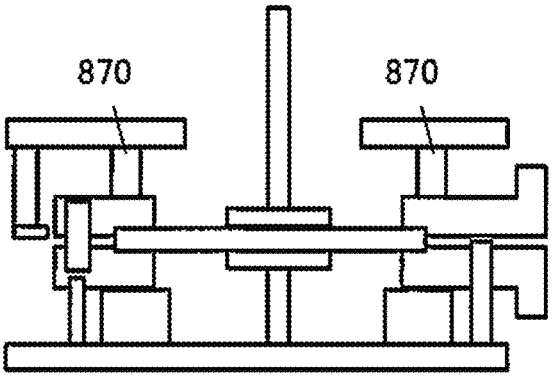
FIG. 9D is a schematic diagram of the pressing portion at a fourth point of time.

FIG. 9D is a schematic diagram of the pressing portion 430 at a fourth point of time. At the fourth point of time, the pressing mechanisms 870 operate, and the rear frame 200*b* is pressed downwards. Through the pressing, the outer seal 300 and the inner seals 310 are compressed, and the rear frame 200*b* approaches the front frame 200*a*. As a result, the clamper opener 860 can open the clamper 290. Since the pressing unit 432 is fixed by the brake 812, the pressing mechanisms 870 can press the rear frame 200*b* hard enough.

Figure 9E:
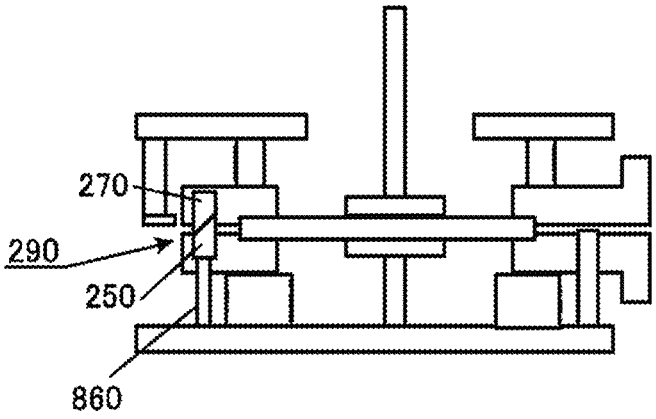
FIG. 9E is a schematic diagram of the pressing portion at a fifth point of time.

FIG. 9E is a schematic diagram of the pressing portion 430 at a fifth point of time. At the fifth point of time, the clamper opener 860 operates, and the clamper opener 860 pivots the hook body 252. The hooking of the hook body 252 to the claw 271 is released by the clamper opener 860, and the clamper 290 is opened. The front frame 200*a* can be prevented from being lifted by the clamper opener 860 as long as the front frame 200*a* is fixed by the fixing clamps 831.

Figure 9F:
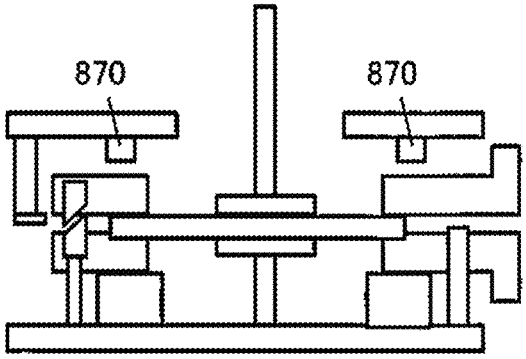
FIG. 9F is a schematic diagram of the pressing portion at a sixth point of time.

FIG. 9F is a schematic diagram of the pressing portion 430 at a sixth point of time. At the sixth point of time, the pressing using the pressing mechanisms 870 is released. Since the clamper 290 is opened at the fifth point of time, when the pressing is released at the sixth point of time, the rear frame 200*b* is slightly raised by the reaction force of the outer seal 300 and the inner seals 310.

Figure 9G:
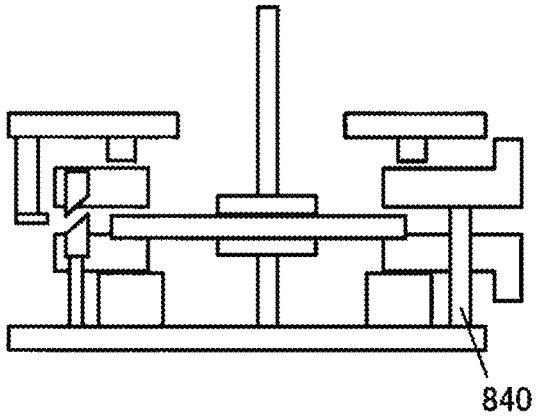
FIG. 9G is a schematic diagram of the pressing portion at a seventh point of time.

FIG. 9G is a schematic diagram of the pressing portion 430 at a seventh point of time. At the seventh point of time, the rear frame 200*b* is further pushed up by the frame pusher 840. The frame pusher 840 generates, between the rear frame 200*b* and the front frame 200*a*, a gap having a size sufficient to insert the frame lifting claw 880.

Figure 9H:
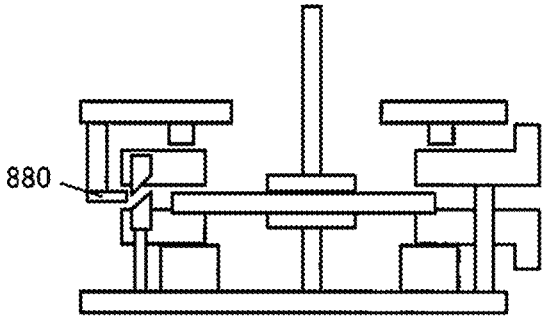
FIG. 9H is a schematic diagram of the pressing portion at an eighth point of time.

FIG. 9H is a schematic diagram of the pressing portion 430 at an eighth point of time. At the eighth point of time, preparation for lifting the rear frame 200*b* is prepared. That is, at the eighth point of time, the frame lifting claw 880 is expanded toward the gap between the rear frame 200*b* and the front frame 200*a*.

Figure 9I:
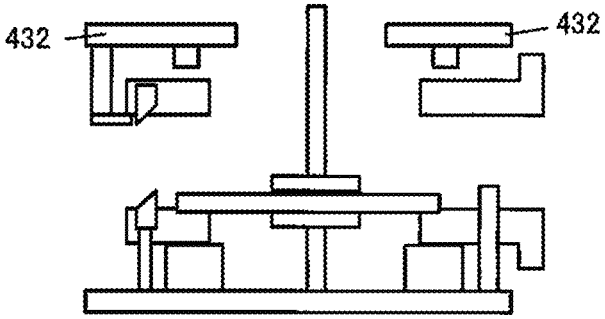
FIG. 9I is a schematic diagram of the pressing portion at a ninth point of time.
Figure 9J:
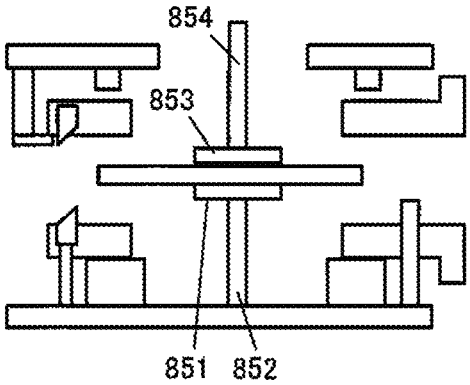
FIG. 9J is a schematic diagram of the pressing portion at a tenth point of time.
Figure 9K:
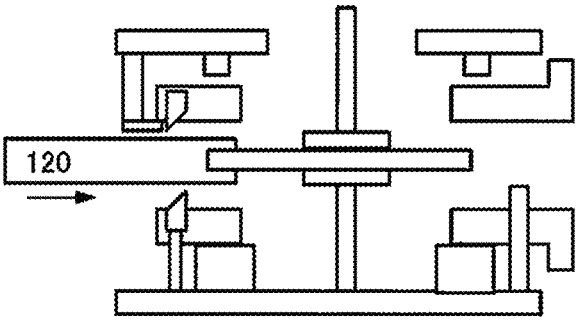
FIG. 9K is a schematic diagram of the pressing portion at an eleventh point of time.

FIG. 9I is a schematic diagram of the pressing portion 430 at a ninth point of time. At the ninth point of time, the pressing unit 432 is raised by the pressing-unit vertical movement mechanism 810 (not shown in FIGS. 9A to 9M). Since the frame lifting claw 880 is hooked to the rear frame 200*b*, the rear frame 200*b* together with the pressing unit 432 is also lifted. Moreover, at the ninth point of time, the brake 812 is released. More accurately, the brake 812 is released before the pressing unit 432 is raised. The brake 812 may be operated again after the pressing unit 432 is lifted to a predetermined height.

FIG. 9J is a schematic diagram of the pressing portion 430 at a tenth point of time. At the tenth point of time, the substrate W is levitated by the substrate supporting unit 850. The lower substrate supporter 851 and the upper substrate supporter 853 are raised, and thereby the substrate W is separated and levitated from the front frame 200*a*. By the levitation of the substrate W, it is easy for the substrate transfer robot 120 to grip the substrate W. That is, since the lower surface of the substrate W is separated from the front frame 200*a*, the substrate transfer robot 120 can transfer the substrate while supporting the lower surface of the substrate. Accordingly, the position of the substrate W shown in FIG. 9J becomes the "second position".

FIG. 9K is a schematic diagram of the pressing portion 430 at an eleventh point of time. Unlike the diagrams described above, the substrate transfer robot 120 is shown in FIG. 9K. At the eleventh point of time, the substrate transfer robot 120 grips the substrate W. Although the substrate transfer robot 120 of FIG. 9K grips only one side of the substrate W for the sake of simplicity, it is desirable that the substrate transfer robot 120 supports the substrate W over the entire surface of the substrate W. Thus, it is desirable that at least one of the lower substrate supporter 851 and the upper substrate supporter 853 has a shape which does not interfere with the substrate transfer robot 120.

Figure 9L:
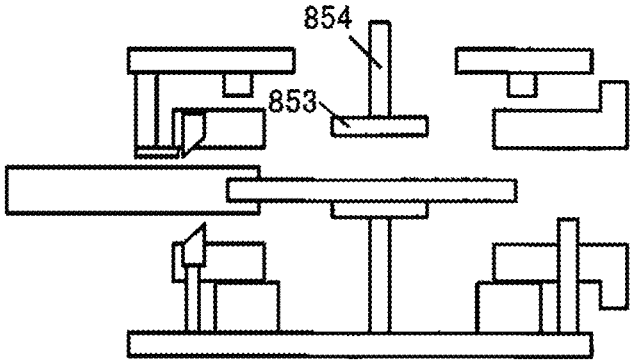
FIG. 9L is a schematic diagram of the pressing portion at a twelfth point of time.

FIG. 9L is a schematic diagram of the pressing portion 430 at a twelfth point of time. At the twelfth point of time, the upper-substrate-supporter vertical movement mechanism 854 is raised. Accordingly, the sandwiching of the substrate using the substrate supporting unit 850 is released. Since the substrate W is gripped by the substrate transfer robot 120, the substrate W does not fall from the lower substrate supporter 851.

Figure 9M:
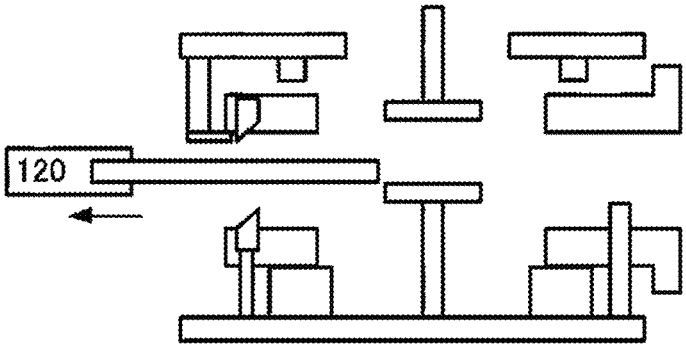
FIG. 9M is a schematic diagram of the pressing portion at a thirteenth point of time.

FIG. 9M is a schematic diagram of the pressing portion 430 at a thirteenth point of time. At the thirteenth point of time, the substrate transfer robot 120 transfers the substrate W from the pressing portion 430. The substrate transfer robot 120 may slightly move upwards or the lower-substrate-supporter vertical movement mechanism 852 may move downwards so that the substrate W and the lower substrate supporter 851 do not rub each other when the substrate W is transferred.

Through the operations of the pressing portion 430 described above, the holding of the substrate W using the substrate holder 200 is released, and the substrate W is unloaded from the substrate attachment and detachment device 140. In order to hold the substrate W in the substrate holder 200, operations in a reverse order of the operations described above (hereinafter, referred to as "forward operations"), that is, operations according to the order from FIG. 9M to FIG. 9A (hereinafter, referred to as "reverse operations") may be performed. The energization between the substrate holder 200 and the substrate W may be confirmed by the energization sensor 892 after the holding of the substrate W using the substrate holder 200 is completed in the reverse operations (that is, at any point of time from FIGS. 9B to 9A). When the energization is not confirmed, the substrate W may be transferred out of the pressing portion 430 through the forward operations. For example, when the energization is not confirmed, after the forward operations are performed until FIG. 9J, the reverse operations may be performed, and the energization between the substrate holder 200 and the substrate W may be confirmed again.

Before the substrate supporting unit 850 sandwiches the substrate W in the reverse operations, that is, at any point of time between FIG. 9L and FIG. 9K, the alignment of the substrate W using the light source 890 and the camera 891 may be performed. The alignment is described with reference to FIGS. 10A and 10B. A point of time described in FIGS. 10A and 10B correspond to the point of time (twelfth point of time) described in FIG. 9L. In the description, the substrate used in FIGS. 10A and 10B has a rectangular shape.

Figure 10A:
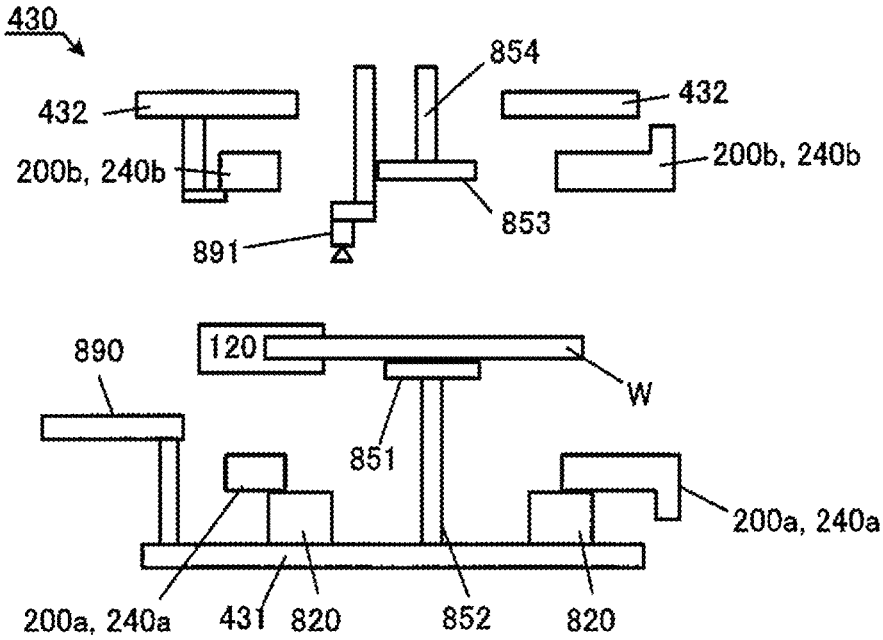
FIG. 10A is a schematic diagram of the pressing portion when both a light source and a camera are present at waiting positions.

FIG. 10A is a schematic diagram of the pressing portion 430 when both the light source 890 and the camera 891 are present at the waiting positions. The light source 890 is positioned outside the mounting unit 820, and the camera 891 is positioned within the pressing unit opening 432*op* and within the opening 260*b*. Here, even if the heights of the component A and the opening are different, it is assumed that the "component A is positioned on the inside of the opening" as long as the entire portion of the component A can be observed through the opening when viewed from directly above or directly below (that is, the component A can pass through the opening when the component A is vertically moved). The light source 890 and the camera 891 present at the waiting positions do not inhibit the attachment and detachment of the substrate W using the pressing portion 430. The light source 890 and the camera 891 wait at the waiting positions except for a case when the alignment of the substrate W is performed.

Figure 10B:
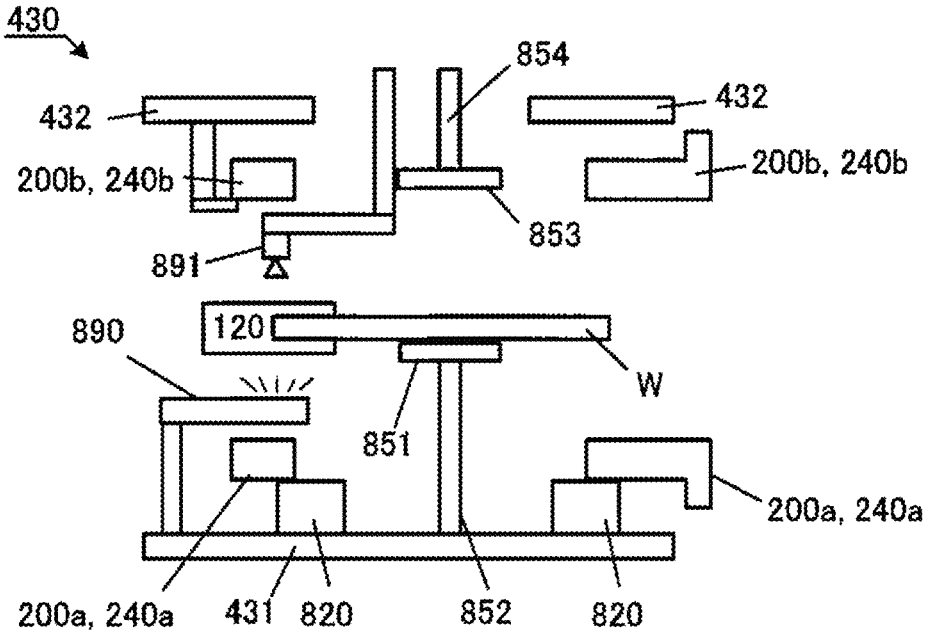
FIG. 10B is a schematic diagram of the pressing portion when the light source is present at an irradiation position and the camera is present at an imaging position.

FIG. 10B is a schematic diagram of the pressing portion 430 when the light source 890 is present at the irradiation position and the camera 891 is present at the imaging position. As stated above, for example, the light source 890 can pivot, and the camera 891 can horizontally move. The imaging position is substantially directly above the irradiation position. The light source 890 present at the irradiation position irradiates the corners of the substrate W gripped by the substrate transfer robot 120 with light. The camera 891 present at the imaging position images the corners of the substrate W gripped by the substrate transfer robot 120. The camera 891 can obtain a sufficient light amount from the light source 890.

Since the imaging position is fixed, the position and/or angle of the substrate W can be calculated from the images obtained by the camera 891. The substrate transfer robot 120 adjusts the position and/or angle of the substrate W based on the calculated position and/or angle of the substrate W. In order to prevent the substrate W and the lower substrate supporter 851 from rubbing each other, the substrate transfer robot 120 may be raised and/or the lower substrate supporter 851 may be lowered during the position adjustment. The light source 890 and the camera 891 are returned to the waiting positions again as soon as the adjustment of the position and/or angle of the substrate W is ended.

In FIGS. 10A and 10B, one set of the light source 890 and the camera 891 is shown. Accordingly, the number of the corners of the substrate W imaged in FIGS. 10A and 10B is one. Preferably, a plurality of corners is imaged in order to adjust the position and/or angle of the substrate W with high accuracy. Specifically, it is preferable that at least one set of diagonals is imaged. Thus, the pressing portion 430 may include a plurality of sets of the light source 890 and the camera 891. For example, the pressing portion 430 of FIGS. 8A to 8C includes two sets of the light source 890 and the camera 891 for imaging one set of diagonals.

The pressing portion 430 may not include the light source 890 as long as sufficient contrast is acquired to detect the positions of the corners of the substrate. In addition, the position and/or angle of the substrate W may be calculated by a sensor such as a laser sensor, a line sensor, or a contact sensor instead of the set of the light source 890 and the camera 891. In addition, a positional relationship between the camera 891, the substrate W, and the light source 890 in a height direction is not particularly limited, and both the camera 891 and the light source 890 may be present above the substrate W. The position of the light source 890 may not be exactly present directly above the camera 891, and may be arranged at a position of a predetermined angle. The sections of the substrate to be referred to in order to detect the position and/or angle of the substrate W are not limited to the corners, and may be, for example, reference marks preset on the substrate W. In the specification, the sections such as the corners and the reference marks of the substrate are collectively referred to as "sections as references for detecting the position and/or angle of the substrate". In the specification, mechanisms that calculate the position and/or angle of the substrate W before the substrate supporting unit 850 sandwiches the substrate are collectively referred to as a "substrate position detection unit". The substrate may not be rectangular in some configurations of the substrate position detection unit.

<Pressing Portion Capable of Coping with "Semi-Locking">

The substrate holder may include a clamper having a "semi-locking function". The semi-locking function refers to a "function of holding the front frame 200*a* and the rear frame 200*b* in a state that the front frame 200*a* and the rear frame 200*b* are separated". Basically, the semi-locking function is a function of combining the front frame 200*a* and the rear frame 200*b* of the substrate holder not holding the substrate. In the semi-locking state, the seals (outer seal 300 and inner seals 310) and contact points (substrate electrodes 320) of the front frame 200*a* and the rear frame 200*b* do not come into contact with each other. The semi-locking of the substrate holder has advantages in terms of the lifespan of the component, easiness of the transfer of the substrate holder, easiness of cleaning of the substrate holder, and so on.

Figure 11:
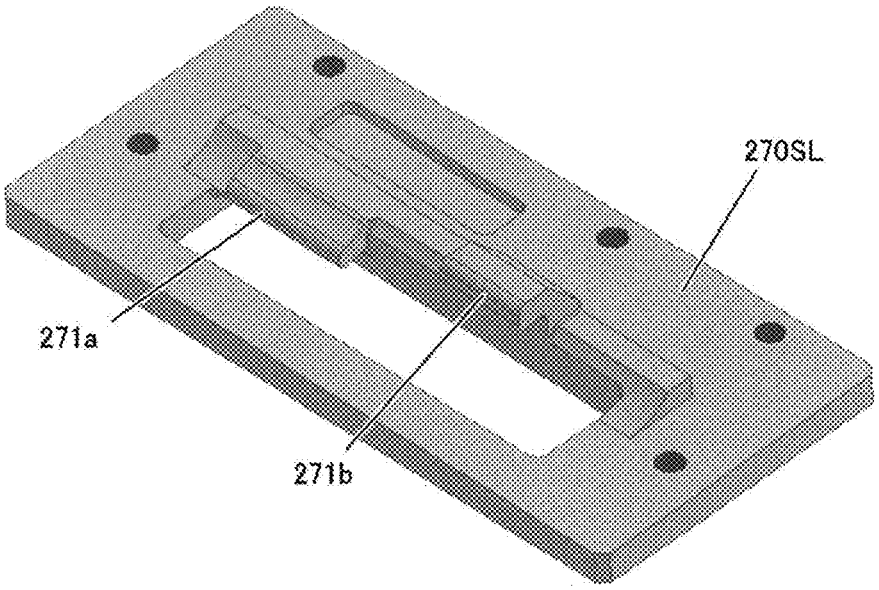
FIG. 11 is a perspective view of a plate of a clamper having a semi-locking function.
Figure 12:
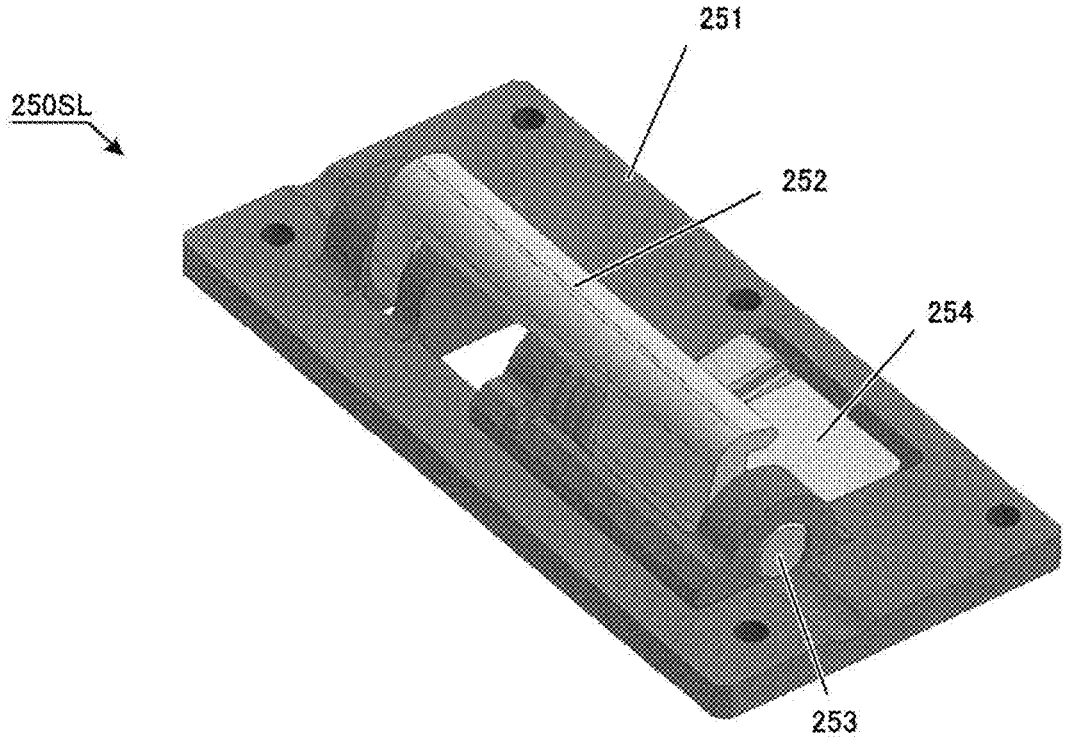
FIG. 12 is a perspective view of a hook portion paired with the plate of FIG. 11.
Figure 13:
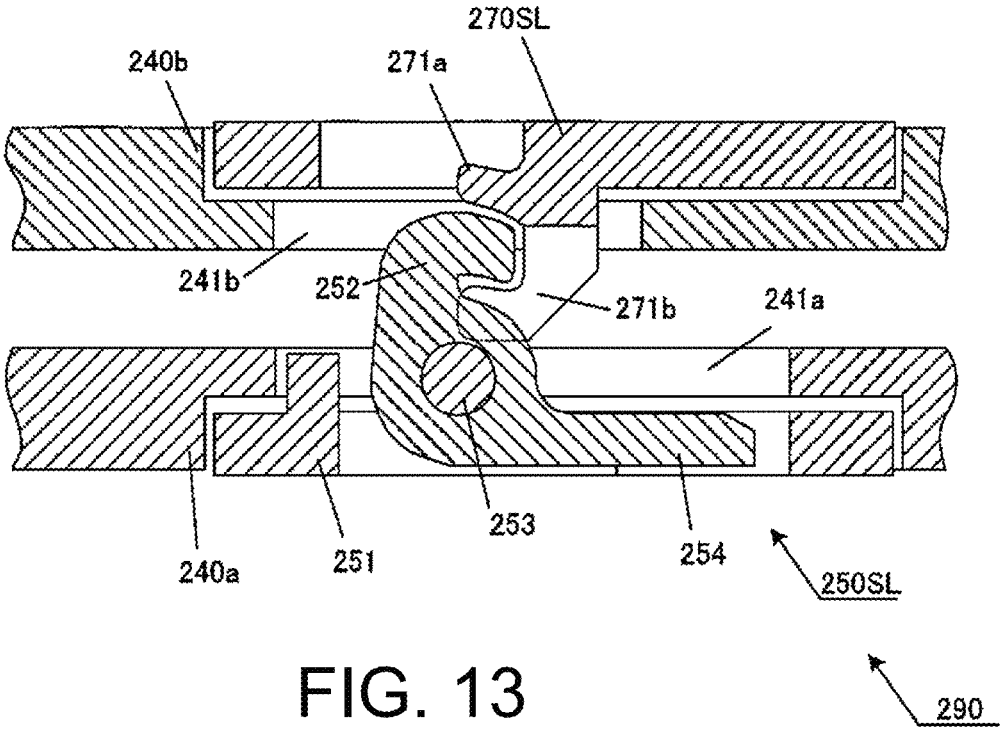
FIG. 13 is a cross-sectional view of a clamper including the plate of FIG. 11 and the hook portion of FIG. 12.

FIG. 11 is a perspective view of the plate of the clamper 290 having the semi-locking function. In the following description, the plate shown in FIG. 11 is referred to as a "plate 270SL". "SL" is the initial of "Semi-Lock". FIG. 12 is a perspective view of the hook portion paired with the plate 270SL. In the following description, the hook portion shown in FIG. 12 is referred to as a "hook portion 250SL". FIG. 13 is a cross-sectional view of the clamper 290 including the plate 270SL of FIG. 11 and the hook portion 250SL of FIG. 12.

The plate 270SL includes two claws 271. Specifically, the plate 270SL includes a locking claw 271*a* and a semi-locking claw 271*b*. The locking claw 271*a* is configured so that the substrate holder 200 can hold the substrate W when the hook body 252 is hooked to the locking claw 271*a*. The semi-locking claw 271*b* is configured so that a distance between the front frame 200*a* and the rear frame 200*b* when the hook body 252 is hooked to the semi-locking claw 271*b* is greater than the distance between the front frame 200*a* and the rear frame 200*b* when the hook body 252 is hooked to the locking claw 271*a*.

The hook portion 250SL includes the hook body 252 expanded in a longitudinal direction of the shaft 253. The hook body 252 is supported by two shafts 253 as the hook body 252 is expanded. The shafts 253 are coaxially arranged. One expanded shaft 253 can be used instead of two shafts 253.

The expanded hook body 252 is selectively hooked to the locking claw 271*a* or the semi-locking claw 271*b*. When the hook body 252 is hooked to the locking claw 271*a*, the clamper 290 is locked. When the hook body 252 is hooked to the semi-locking claw 271*b*, the clamper 290 is semi-locked (also referred to as the "substrate holder 200 is semi-locked"). When the substrate holder 200 is semi-locked, the outer seal 300 and the inner seals 310 are in a state that the outer seal 300 and the inner seals 310 are not compressed at all or slightly compressed, or a state that the outer seal 300 and the inner seals 310 are separated from each other.

Through a procedure shown below as an example, the substrate holder 200 is semi-locked.

(a) In FIG. 9M, after the substrate W is unloaded by the substrate transfer robot 120, the pressing unit 432 is lowered by the pressing-unit vertical movement mechanism 810 to a position at which the hook body 252 can be hooked to the semi-locking claw 271*b*.

(b) The pivoting of the hook body 252 using the clamper opener 860 is released, and the hook body 252 is hooked to the semi-locking claw 271*b*.

Figure 14:
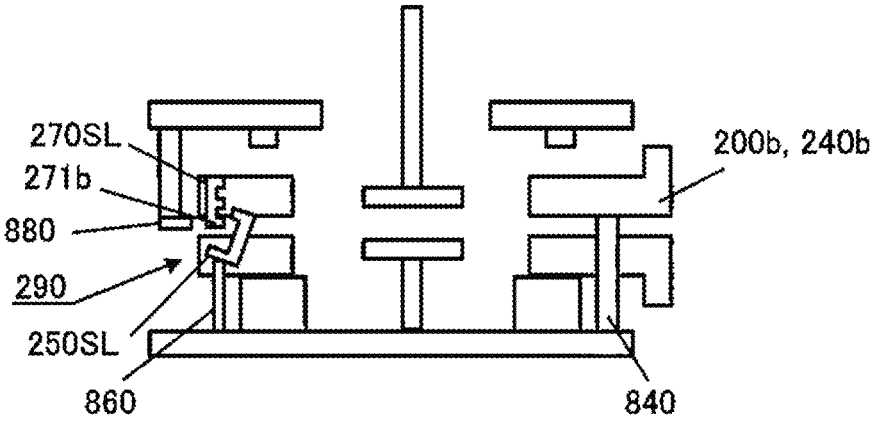
FIG. 14 is a schematic diagram of the pressing portion according to an embodiment.

A schematic diagram of the pressing portion 430 according to the embodiment is shown in FIG. 14. FIG. 9A is to be referred to for reference symbols of the components to which references symbols are not marked in FIG. 14. In a preferred embodiment, the frame positioned on the upper side is pushed up by the frame pusher 840 to a position at which the frame lifting claw 880 can be inserted between the frames and the hook body 252 can be hooked to the semi-locking claw 271*b*. That is, a height at which the frame pusher 840 lifts the rear frame 200*b* and a height (of the rear frame 200*b*) at which the hook body 252 can be hooked to the semi-locking claw 271*b* are the same so that the frame lifting claw 880 can be inserted between the frames. In FIG. 9M, after the substrate W is unloaded by the substrate transfer robot 120, the pressing-unit vertical movement mechanism 810 lowers the rear frame 200*b* in a state that the frame pusher 840 is expanded upwards, and mounts the rear frame 200*b* on a protrusion portion of the frame pusher 840. The preferable pressing portion 430 can semi-lock the substrate holder 200 through relatively simple control.

<Position at which Substrate Supporter Sandwiches Substrate>

The lower-substrate-supporter vertical movement mechanism 852 and the lower-substrate-supporter vertical movement mechanism 854 according to the embodiment are respectively pneumatic mechanisms (air cylinders). The substrate supporting unit 850 can move between at least two positions while sandwiching the substrate W.

In the embodiment, the position at which the substrate supporting unit 850 sandwiches the substrate W can be selected by adjusting pressures to be supplied to the lower-substrate-supporter vertical movement mechanism 852 and the upper-substrate-supporter vertical movement mechanism 854. When the substrate W is sandwiched at the first position, the pressure to be supplied to the lower-substrate-supporter vertical movement mechanism 852 is lower than the pressure to be supplied to the upper-substrate-supporter vertical movement mechanism 854. When the substrate W is sandwiched at the second position, the pressure to be supplied to the lower-substrate-supporter vertical movement mechanism 852 is higher than the pressure to be supplied to the upper-substrate-supporter vertical movement mechanism 854. Preferably, when the substrate W is raised or lowered between the first position and the second position, a state in which the lower substrate supporter 851 and the upper substrate supporter 853 constantly push the substrate W together is also maintained by adjusting the pressure to be supplied to the lower-substrate-supporter vertical movement mechanism 852 and the upper-substrate-supporter vertical movement mechanism 854.

Since both the lower-substrate-supporter vertical movement mechanism 852 and the upper-substrate-supporter vertical movement mechanism 854 are pneumatic mechanisms, there is a low possibility of failure caused by mutual pushing of these mechanisms. Through the above-described control, even if an expensive and complicated height measurement mechanism (height adjustment mechanism) is not arranged, it is possible to select the position at which the substrate W is to be sandwiched while preventing the substrate W from falling out from the substrate supporting unit 850.

In the above-described examples, the substrate holder includes the clamper that sandwiches the substrate by two frames in a state that the seal pressure is generated, and the pressing unit has the function of pressing the rear frame 200*b* toward the front frame 200*a* in order to fasten and release the clamper. However, for example, when the substrate holder itself can generate seal pressure, the substrate attachment and detachment device 140 may not have the function of pressing the rear frame 200*b*. In such a case, the substrate attachment and detachment device 140 may have a function of positioning the rear frame 200*b* at least two positions of (1) a position at which the substrate is sandwiched and (2) a position at which the substrate is detached from the substrate holder. In this case, the stage 431 may be referred to as a first base, and the pressing unit may be referred to as a second base. In this case, the pressing portion 430 is referred to as a "substrate attachment and detachment portion" or a "fixing portion".

Moreover, although the substrate holder including the frame having the square-shaped opening is described above as an example, the example of the opening is not limited thereto. For example, when the substrate holder for performing electrolytic plating on a square-shaped substrate is used, power supply electrodes may be arranged along only one set of edges facing each other. In this case, sections of the substrate holder at which the power supply electrodes are arranged along an outer periphery of the substrate may be present along only one set of edges facing each other. Accordingly, one set of edges of the substrate to which the power is not supplied may be exposed. When the substrate holder at which the sections of the substrate holder are present along only one set of edges facing each other is used, a region between these sections becomes an opening that exposes the substrate.

In the disclosure, at a point of time when the substrate holder holding the substrate is transferred to the pressing portion (substrate attachment and detachment portion) 430, the lower substrate supporter 851 is present at a position lower than the front frame 200*a*, and the upper substrate supporter 853 is present at a position higher than the rear frame 200*b*. Thus, the substrate supporting unit 850 does not disturb the transfer of the substrate holder. Furthermore, the lower substrate supporter 851 passes through the opening 260*a* and the upper substrate supporter 853 passes through the opening 260*b*, sandwiching the substrate at the first position. Furthermore, the substrate supporting unit 850 can move the substrate to the second position. The second position is a position appropriate to deliver the substrate to the substrate attachment and detachment device or receive the substrate from the substrate attachment and detachment device. As mentioned above, the lower substrate supporter 851 needs to pass through the opening 260*a*, and the upper substrate supporter 853 needs to pass through the opening 260*b*. Thus, for example, the lower substrate supporter 851 is configured to be smaller than the opening 260*a*, and the upper substrate supporter 853 is configured to be smaller than the opening 260*b*.

<Vertical Type Pressing Portion (Substrate Attachment and Detachment Portion)>

Figure 15:
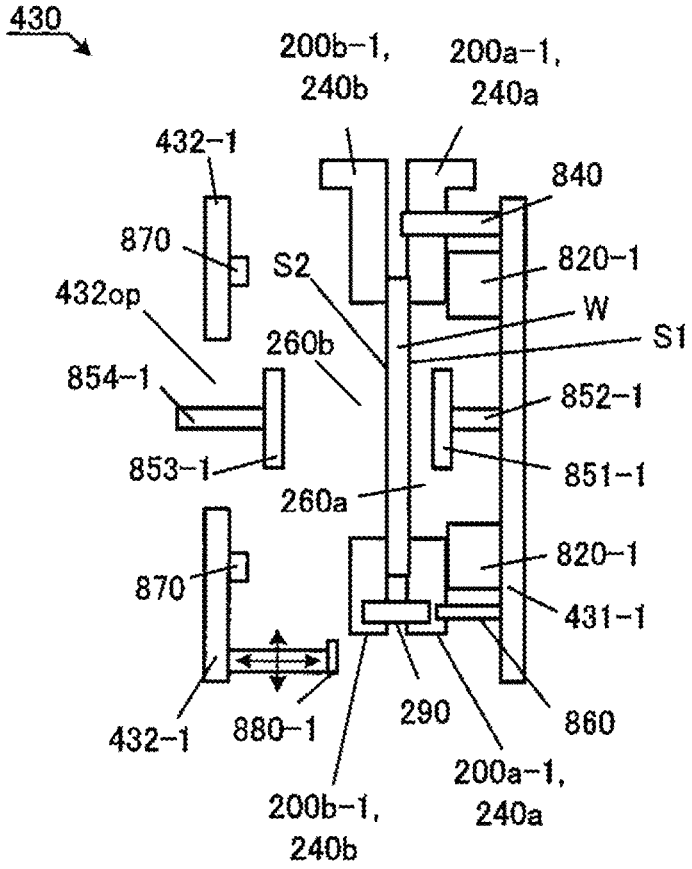
FIG. 15 is a diagram showing an example in which the substrate is attached to or detached from the substrate holder in a vertical pose.

It is described above that the substrate attachment and detachment device attaches the substrate to or detaches the substrate from the substrate holder in a horizontal pose. However, it should be understood by those skilled in the art that the disclosure is also applicable to substrates other than the substrate in the horizontal pose. FIG. 15 shows an example in which the substrate is attached to or detached from the substrate holder in a vertical pose.

A first frame 200*a*-1 corresponds to the front frame 200*a* in the horizontal pose of the example and faces one surface S1 of the substrate. A second frame 200*b*-1 corresponds to the rear frame 200*b* and faces the other surface S2 of the substrate. The first frame 200*a*-1 and/or the second frame 200*b*-1 may include a member for preventing the substrate W from falling. A first base 431-1 corresponds to the stage 431 and is disposed so as to face the one surface S1 of the substrate. A second base 432-1 corresponds to the pressing unit 432 and is disposed so as to face the other surface S2 of the substrate. A first substrate supporter 851-1 corresponds to the lower substrate supporter 851 and is disposed so as to face the other surface S1 of the substrate. A first-substrate-supporter movement mechanism 852-1 corresponds to the lower-substrate-supporter vertical movement mechanism 852 and moves the first substrate supporter 851-1 so that the first substrate supporter 851-1 approaches the substrate W or gets away from the substrate W. A second substrate supporter 853-1 corresponds to the upper substrate supporter 853 and is disposed so as to face the other surface S2 of the substrate. A second-substrate-supporter movement mechanism 854-1 corresponds to the upper-substrate-supporter vertical movement mechanism 854 and moves the second substrate supporter 853-1 so that the second substrate supporter 853-1 approaches the substrate W or gets away from the substrate W. An abutting unit 820-1 corresponds to the mounting unit 820 and is arranged at the first base 431-1. The abutting unit 820-1 abuts against the first frame 200*a*-1. A claw 880-1 corresponds to the frame lifting claw 880 and is arranged at the second base 432-1. In order to prevent the second frame 200*b*-1 from falling after the clamper 290 is released, the claw 880-1 can support a lower end portion of the second frame 200*b* and further cause the second frame 200*b* to slide in a direction away from the substrate. Thus, the claw 880-1 is preferably configured to be capable of moving along up, down, left, and light directions of FIG. 15. The first base 431-1 includes a fixing clamp or the like (not shown) that fixes the first frame 200*a*-1. Other sections shown in FIG. 15 have the same functions as those in the example of the horizontal pose.

In FIG. 15, a name of the component to which an end number is marked like "*-1" is a general name of the component to which the end number is not marked in the diagrams other than FIG. 15. Accordingly, for example, the "stage 431" shown in the diagrams other than FIG. 15 may be referred to as the "first base 431**".

Although some embodiments of the disclosure are described above, the above-described embodiments of the disclosure are provided for facilitating the understanding of the disclosure and do not limit the disclosure. Obviously, the disclosure may be changed and modified without departing from the gist, and the equivalents thereof are included in the disclosure. In addition, any combination or omission of constituent elements described in the claims and specification can be made within a scope in which at least a part of the above-described problems can be solved or a scope in which at least a part of the advantageous effects can be acquired.

In the above, the substrate holder 200 is described as a double-sided holder. However, the substrate holder 200 is not limited to the double-sided holder and may be a one-sided holder. In addition, as stated above, the substrate attachment and detachment device 140 may not include the holder reception portion 400, the holder tilting portion 410, and the holder transfer portion 420. In other words, the substrate attachment and detachment device 140 may include only the pressing portion 430. Accordingly, unless there is inconsistency, the pressing portion 430 may be regarded as the substrate attachment and detachment device 140, and the pressing portion 430 may be referred to as the substrate attachment and detachment device 140. For example, the description of "the pressing portion 430 includes a component A" can be replaced by "the substrate attachment and detachment device 140 includes a component A".

The application discloses, as an embodiment, a device that holds a substrate in a substrate holder and/or releases the holding of the substrate using the substrate holder. The substrate holder includes a first frame and a second frame that sandwich the substrate. The first frame and the second frame have openings that expose the substrate, respectively. The device includes a substrate supporting unit that sandwiches the substrate between the first frame and the second frame. The substrate supporting unit includes a lower substrate supporter that supports the substrate from below, and an upper substrate supporter that supports the substrate from above. The lower substrate supporter is configured to come into contact with the substrate through the opening of the frame of the first frame and the second frame which is positioned on a lower side. The upper substrate supporter is configured to come into contact with the substrate through the opening of the frame of the first frame and the second frame which is positioned on an upper side.

The application further discloses, as an embodiment, the device in which the substrate supporting unit includes a lower-substrate-supporter vertical movement mechanism that vertically moves the lower substrate supporter, and an upper-substrate-supporter vertical movement mechanism that vertically moves the upper substrate supporter; and the substrate supporting unit is configured to be capable of moving the substrate between a first position at which the substrate can be sandwiched by the first frame and the second frame and a second position which is higher than the first position and at which the substrate can be unloaded from the device.

The application further discloses, as an embodiment, the device that includes a first base on which the substrate holder is horizontally mounted, and a second base that is disposed above the first base and configured to be capable of moving vertically. The second base positions the frame of the first frame and the second frame which is positioned on the upper side so that the substrate can be sandwiched by the first frame and the second frame, and the second base is configured to be capable of lifting the frame of the first frame and the second frame which is positioned on the upper side.

The application further discloses, as an embodiment, the device in which the second base is configured to press the substrate holder mounted on the first base toward the first base.

The application further discloses, as an embodiment, the device in which the second base includes a frame lifting claw that lifts the frame of the first frame and the second frame which is positioned on the upper side, the first base includes a frame pusher that lifts the frame of the first frame and the second frame which is positioned on the upper side, and the frame pusher forms, between the first frame and the second frame, a gap into which the frame lifting claw is inserted.

The application further discloses, as an embodiment, the device in which the frame pusher lifts the first frame or the second frame to a position at which the substrate holder can be semi-locked.

The application further discloses, as an embodiment, the device in which the substrate holder includes a clamper that clamps the first frame and the second frame. The device includes a clamper opener that opens the clamper.

The application discloses, as an embodiment, the device that further includes a substrate position detection unit that calculates a position and/or an angle of the substrate before the substrate supporting unit sandwiches the substrate.

The application further discloses, as an embodiment, the device in which the substrate position detection unit is at least one set of a light source and a camera, the light source is configured to be capable of moving between a light source waiting position at which attachment and detachment of the substrate are not inhibited and an irradiation position at which a corner of the substrate can be irradiated with light, and the camera is configured to be capable of moving between a camera waiting position at which the attachment and detachment of the substrate are not inhibited and which is present within the opening of the frame of the first frame and the second frame which is positioned on the upper side and an imaging position at which a section of the substrate which is irradiated by the light source and is a reference for detecting the position and/or the angle of the substrate can be imaged.

The application further discloses, as an embodiment, a device that holds a substrate in a substrate holder and/or releases the holding of the substrate using the substrate holder. The substrate holder includes a first frame facing a first surface of the substrate and used to sandwich the substrate, and a second frame facing a second surface of the substrate and used to sandwich the substrate. The first frame and the second frame have openings that expose the substrate, respectively. The device includes a substrate supporting unit that sandwiches the substrate between the first frame and the second frame. The substrate supporting unit includes a first substrate supporter that supports the first surface of the substrate and a second substrate supporter that supports the second surface of the substrate. The first substrate supporter is configured to come into contact with the substrate through the opening of the first frame. The second substrate supporter is configured to come into contact with the substrate through the opening of the second frame.

These devices exhibit, as an example, an effect of being appropriate for a double-sided holder.

The application further discloses, as an embodiment, a plating apparatus including a plating treatment portion that performs plating on a substrate held by a substrate holder, the device that holds the substrate in the substrate holder and/or releases the holding of the substrate using the substrate holder, a transporter that transfers the substrate holder between the plating treatment portion and the device, and a substrate transfer robot that receives the substrate from the device and delivers the substrate to the device.

The application further discloses, as an example, a plating apparatus including a plating treatment portion that performs plating on a substrate held by a substrate holder, the device that holds the substrate in the substrate holder and/or releases the holding of the substrate using the substrate holder and includes a substrate position detection unit, a transporter that transfers the substrate holder between the plating treatment portion and the device, and a substrate transfer robot that receives the substrate from the device and delivers the substrate to the device. The substrate transfer robot is capable of adjusting, based on a position and/or an angle of the substrate calculated by the substrate position detection unit, the position and/or the angle of the substrate when the substrate is delivered to the device.

Through these disclosures, the details of the plating apparatus including the device that holds the substrate in the substrate holder and/or releases the holding of the substrate using the substrate holder become apparent.

What is claimed is:

1. A device that holds a substrate in a substrate holder and/or releases the substrate from the substrate holder, wherein the substrate holder comprises a first frame and a second frame that sandwich the substrate, the first frame and the second frame have openings that expose the substrate, respectively, the device comprises a substrate supporting unit that sandwiches the substrate between the first frame and the second frame, the substrate supporting unit comprises a lower substrate supporter that supports the substrate from below, and an upper substrate supporter that supports the substrate from above, the lower substrate supporter is configured to come into contact with the substrate through the opening of the first frame which is positioned on a lower side, and the upper substrate supporter is configured to come into contact with the substrate through the opening of the second frame which is positioned on an upper side.

2. The device according to claim 1, wherein the substrate supporting unit comprises a lower-substrate-supporter vertical movement mechanism that vertically moves the lower substrate supporter, and an upper-substrate-supporter vertical movement mechanism that vertically moves the upper substrate supporter, and the substrate supporting unit is configured to be capable of moving the substrate between a first position at which the substrate is capable of being sandwiched by the first frame and the second frame and a second position which is higher than the first position and at which the substrate is capable of being unloaded from the device.

3. The device according to claim 1, further comprising:

a first base on which the substrate holder is horizontally mounted; and a second base that is disposed above the first base and configured to be capable of moving vertically, wherein the second base positions the second frame which is positioned on the upper side so that the substrate is sandwiched by the first frame and the second frame, and the second base is configured to be capable of lifting the second frame which is positioned on the upper side.

4. The device according to claim 3, wherein the second base is configured to press the substrate holder mounted on the first base toward the first base.

5. The device according to claim 3, wherein the second base comprises a frame lifting claw that lifts the second frame which is positioned on the upper side, the first base comprises a frame pusher that lifts the second frame which is positioned on the upper side, and the frame pusher forms, between the first frame and the second frame, a gap into which the frame lifting claw is inserted.

6. The device according to claim 5, wherein the frame pusher lifts the first frame or the second frame to a position at which the substrate holder is capable of being semi-locked.

7. The device according to claim 1, wherein the substrate holder comprises a clamper that clamps the first frame and the second frame, and the device further comprises a clamper opener that opens the clamper.

8. The device according to claim 1, further comprising:

a substrate position detection unit that calculates a position and/or an angle of the substrate before the substrate supporting unit sandwiches the substrate.

9. The device according to claim 8, wherein the substrate position detection unit is at least one set of a light source and a camera, the light source is configured to be capable of moving between a light source waiting position at which attachment and detachment of the substrate are not inhibited and an irradiation position at which a corner of the substrate is capable of being irradiated with light, and the camera is configured to be capable of moving between a camera waiting position at which the attachment and detachment of the substrate are not inhibited and which is present within the opening of the second frame which is positioned on the upper side and an imaging position at which a section of the substrate which is irradiated by the light source and is a reference for detecting the position and/or the angle of the substrate is capable of being imaged.

10. A plating apparatus comprising:

a plating treatment portion that performs plating on a substrate held by a substrate holder;

the device according to claim 1 that holds the substrate in the substrate holder and/or releases the substrate from the substrate holder;

a transporter that transfers the substrate holder between the plating treatment portion and the device; and a substrate transfer robot that receives the substrate from the device and delivers the substrate to the device.

11. A plating apparatus comprising:

a plating treatment portion that performs plating on a substrate held by a substrate holder;

the device according to claim 8 that holds the substrate in the substrate holder and/or releases the substrate from the substrate holder;

a transporter that transfers the substrate holder between the plating treatment portion and the device; and a substrate transfer robot that receives the substrate from the device and delivers the substrate to the device, wherein the substrate transfer robot is capable of adjusting, based on a position and/or an angle of the substrate calculated by the substrate position detection unit, the position and/or the angle of the substrate when the substrate is delivered to the device.

12. A device that holds a substrate in a substrate holder and/or releases the substrate from the substrate holder, wherein the substrate holder comprises a first frame facing a first surface of the substrate and used to sandwich the substrate, and a second frame facing a second surface of the substrate and used to sandwich the substrate, the first frame and the second frame have openings that expose the substrate, respectively, the device comprises a substrate supporting unit that sandwiches the substrate between the first frame and the second frame, the substrate supporting unit comprises a first substrate supporter that supports the first surface of the substrate and a second substrate supporter that supports the second surface of the substrate, the first substrate supporter is configured to come into contact with the substrate through the opening of the first frame, and the second substrate supporter is configured to come into contact with the substrate through the opening of the second frame.

* * * * *